US008256517B2

(12) United States Patent
Ingraham et al.

(10) Patent No.: US 8,256,517 B2
(45) Date of Patent: Sep. 4, 2012

(54) DOWNHOLE MULTIPLE BORE TUBING APPARATUS

(75) Inventors: Derek Ingraham, Conroe, TX (US); Bruce Cram, Airdie (CA)

(73) Assignee: Smith International, Inc., Houston, TX (US)

( * ) Notice: Subject to any disclaimer, the term of this patent is extended or adjusted under 35 U.S.C. 154(b) by 282 days.

(21) Appl. No.: 12/649,996

(22) Filed: Dec. 30, 2009

(65) Prior Publication Data

US 2010/0163240 A1 Jul. 1, 2010

Related U.S. Application Data

(60) Provisional application No. 61/142,120, filed on Dec. 31, 2008.

(51) Int. Cl.
*E21B 43/00* (2006.01)

(52) U.S. Cl. ..... 166/313; 166/50; 166/308.1

(58) Field of Classification Search ..... 166/313, 166/50, 308.1
See application file for complete search history.

(56) References Cited

U.S. PATENT DOCUMENTS

| | | | | |
|---|---|---|---|---|
| 6,158,513 | A * | 12/2000 | Nistor et al. | 166/313 |
| 6,311,776 | B1 * | 11/2001 | Pringle et al. | 166/313 |
| 6,619,398 | B2 * | 9/2003 | MacKenzie et al. | 166/285 |
| 6,712,148 | B2 * | 3/2004 | Fipke et al. | 166/381 |
| 6,732,801 | B2 * | 5/2004 | Ohmer et al. | 166/313 |
| 6,907,930 | B2 * | 6/2005 | Cavender et al. | 166/313 |
| 2002/0053433 | A1 | 5/2002 | Mackenzie et al. | |

FOREIGN PATENT DOCUMENTS

| | | |
|---|---|---|
| GB | 2340152 A | 2/2000 |
| GB | 2372270 A | 8/2002 |
| GB | 2410270 A | 7/2005 |
| GB | 2423321 A | 8/2006 |

OTHER PUBLICATIONS

Combined Search Report and Written Opinion dated Mar. 30, 2010 for Patent Application No. GB0922283.7.

* cited by examiner

*Primary Examiner* — Nicole Coy
(74) *Attorney, Agent, or Firm* — Rodney Warfford; William Ryann; Tim Curington

(57) ABSTRACT

A tubing assembly for entering multiple boreholes includes an outer shroud having an axial throughbore, and an inner tubular member disposed in the axial throughbore, wherein the tubular member is releasably coupled to the shroud, and wherein the outer diameter of the shroud is adjustable. A tubing assembly for entering multiple boreholes may also include a shroud having an axial throughbore, a movable tubular member disposed in the axial throughbore, and a releasable coupling between the shroud and the tubular member, wherein the releasable coupling includes a retracted position allowing entry of the tubing assembly into a junction between two boreholes, wherein the releasable coupling includes an expanded position allowing movement of the tubular member relative to the shroud and prevents re-entry of the tubing assembly into the junction.

21 Claims, 28 Drawing Sheets

DOWNHOLE MULTIPLE BORE TUBING APPARATUS

CROSS-REFERENCE TO RELATED APPLICATIONS

The present application claims the benefit of U.S. Provisional Application Ser. No. 61/142,120, filed Dec. 31, 2008, entitled Downhole Single Trip Multiple Bore Tubing Apparatus.

BACKGROUND

This disclosure relates generally to hydrocarbon exploration and production, and in particular, to managing placement of wellbore tubulars in a borehole to facilitate hydrocarbon exploration and production.

A borehole may be drilled into the ground to explore and produce a hydrocarbon reservoir therein. This borehole may be referred to as the main or primary borehole. To further explore and/or increase production from the reservoir, one or more lateral boreholes may be drilled which branch from the main borehole. Such drilling extends the reach of the well into laterally displaced portions of the reservoir. During downhole operations, it may be necessary to separately and selectively enter the main and lateral boreholes with a wellbore tubular. For example, a fracturing tube may be placed in a lateral borehole for fracturing operations in the lateral well then removed to the surface. Another trip into the main borehole with a fracturing tube will allow separate fracturing operations in the main well. Other operations may also require separate entry of a tubular into multiple boreholes, such as for delivering tools downhole, fishing operations, or other remedial services.

Current tools for selectively inserting a tubular member into main and lateral boreholes are cumbersome and inefficient. Furthermore, multiple trips into the well to selectively enter the different boreholes increase the time it takes to complete the downhole operation, thereby increasing the overall cost of the operation. The principles of the present disclosure are directed to overcoming one or more of the limitations of the existing apparatus and processes for separately and selectively entering multiple boreholes of a well.

SUMMARY

An embodiment of a tubing assembly for disposing a tubular member in multiple boreholes in a single trip into the primary well includes an outer shroud having an axial throughbore, and an inner tubular member disposed in the axial throughbore, wherein the tubular member is releasably coupled to the shroud, wherein the outer diameter of the shroud is adjustable with a movable member. The releasable coupling between the tubular member and the shroud may increase the outer diameter of the shroud when released. The releasable coupling may include the movable member formed in the outer shroud, wherein the movable member is radially outwardly biased to an increased diameter position of the outer shroud. The movable member may include a leaf spring including a latch dog. The movable member may include a radially contracted position wherein a shear member releasably couples the movable member and the outer shroud to the tubular member. The assembly may further include an interacting retention mechanism resisting upward movement of the tubular member relative to the shroud. The interacting retention mechanism may include a first engagement shoulder on the tubular member and a second engagement shoulder on the shroud. The second engagement shoulder may be disposed on collets at an upper end of the shroud. The assembly may further include a deflector anchored in a first borehole and adjacent a junction between the first borehole and a second borehole. The deflector may include a ramp and an axial throughbore with an inner diameter. The outer diameter of the shroud may be greater than the inner diameter of the deflector throughbore. The assembly may further include a receptacle disposed in the second borehole to receive the outer shroud. The assembly may further include a polished bore protector disposed in the second borehole to receive and connect to the tubular member. The assembly may further comprise an engagement shoulder on the first borehole above the junction, wherein the movable member on the outer shroud engages the shoulder to prevent downward movement of the shroud in the first borehole. The outer diameter of the tubular member may be less than the inner diameter of the deflector throughbore for passage of the tubular member through the deflect bore.

An embodiment of a tubing assembly for disposing a tubular member in multiple boreholes in a single trip into the primary well includes a shroud having an axial throughbore, a movable tubular member disposed in the axial throughbore, and a releasable coupling between the shroud and the tubular member, wherein the releasable coupling includes a retracted position allowing entry of the tubing assembly into a junction between two boreholes, wherein the releasable coupling includes an expanded position allowing movement of the tubular member relative to the shroud and prevents re-entry of the tubing assembly into the junction. The assembly may include a shear member that couples to a leaf spring of the releasable coupling in the retracted position, and the member may be sheared to outwardly release the leaf spring in the expanded position. The retracted releasable coupling may bypass a borehole engagement shoulder above the junction, and a tubular member shoulder may engage a shroud shoulder and a movable member of the releasable coupling may engage the borehole shoulder in the expanded position.

A method for selectively entering multiple boreholes with a tubing string includes disposing a tubing string in a first bore of a primary well, executing a first operation in the first bore using the tubing string, removing the tubing string from the first bore and disposing the tubing string in a second bore in a single trip of the tubing string into the primary well, and executing a second operation in the second bore using the tubing string. The method may further include coupling the tubing string to an outer shroud to form an assembly, and passing the assembly through a borehole shoulder disposed above a junction between the first and second bores. The method may further include deflecting the assembly into the first bore, releasing the tubing string from the outer shroud, and extending the tubing string from the outer shroud further into the first bore. The method may further include retracting the tubing string from the first bore, engaging the tubing string with the outer shroud to re-form the assembly, and lifting the assembly above the junction. The method may further include radially expanding a portion of the outer shroud, lowering the assembly, engaging the expanded shroud portion with the borehole shoulder above the junction, and extending the tubing string from the outer shroud into the second bore.

BRIEF DESCRIPTION OF THE DRAWINGS

For a more detailed description of the embodiments of the present disclosure, reference will now be made to the accompanying drawings, wherein.

DETAILED DESCRIPTION

Figure 1:
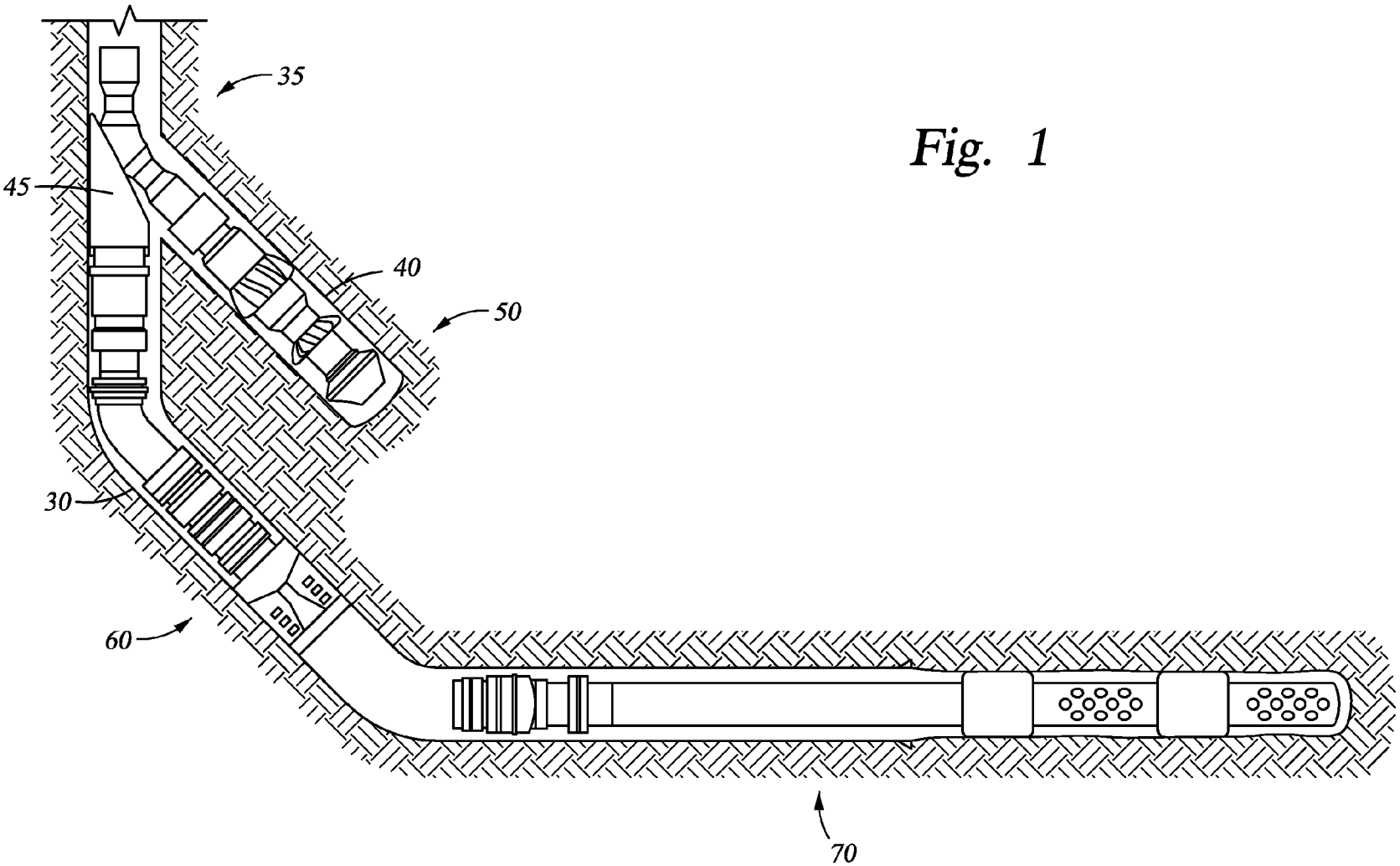
FIG. 1 is a schematic view of a system for milling and drilling a lateral borehole from a primary borehole.

In the drawings and description that follow, like parts are typically marked throughout the specification and drawings with the same reference numerals. The drawing figures are not necessarily to scale. Certain features of the disclosure may be shown exaggerated in scale or in somewhat schematic form and some details of conventional elements may not be shown in the interest of clarity and conciseness. The present disclosure is susceptible to embodiments of different forms. Specific embodiments are described in detail and are shown in the drawings, with the understanding that the present disclosure is to be considered an exemplification of the principles of the inventive concept, and is not intended to limit the disclosure to that illustrated and described herein. It is to be fully recognized that the different teachings of the embodiments discussed below may be employed separately or in any suitable combination to produce desired results.

In the following discussion and in the claims, the terms "including" and "comprising" are used in an open-ended fashion, and thus should be interpreted to mean "including, but not limited to . . . ". Unless otherwise specified, any use of any form of the terms "connect", "engage", "couple", "attach", or any other term describing an interaction between elements is not meant to limit the interaction to direct interaction between the elements and may also include indirect interaction between the elements described. The terms "pipe," "tubular member," "casing" and the like as used herein shall include tubing and other generally cylindrical objects. In addition, in the discussion and claims that follow, it may be sometimes stated that certain components or elements are in fluid communication or fluidicly coupled. By this it is meant that the components are constructed and interrelated such that a fluid could be communicated between them, as via a passageway, tube, or conduit. The various characteristics mentioned above, as well as other features and characteristics described in more detail below, will be readily apparent to those skilled in the art upon reading the following detailed description of the embodiments, and by referring to the accompanying drawings.

Figure 2:
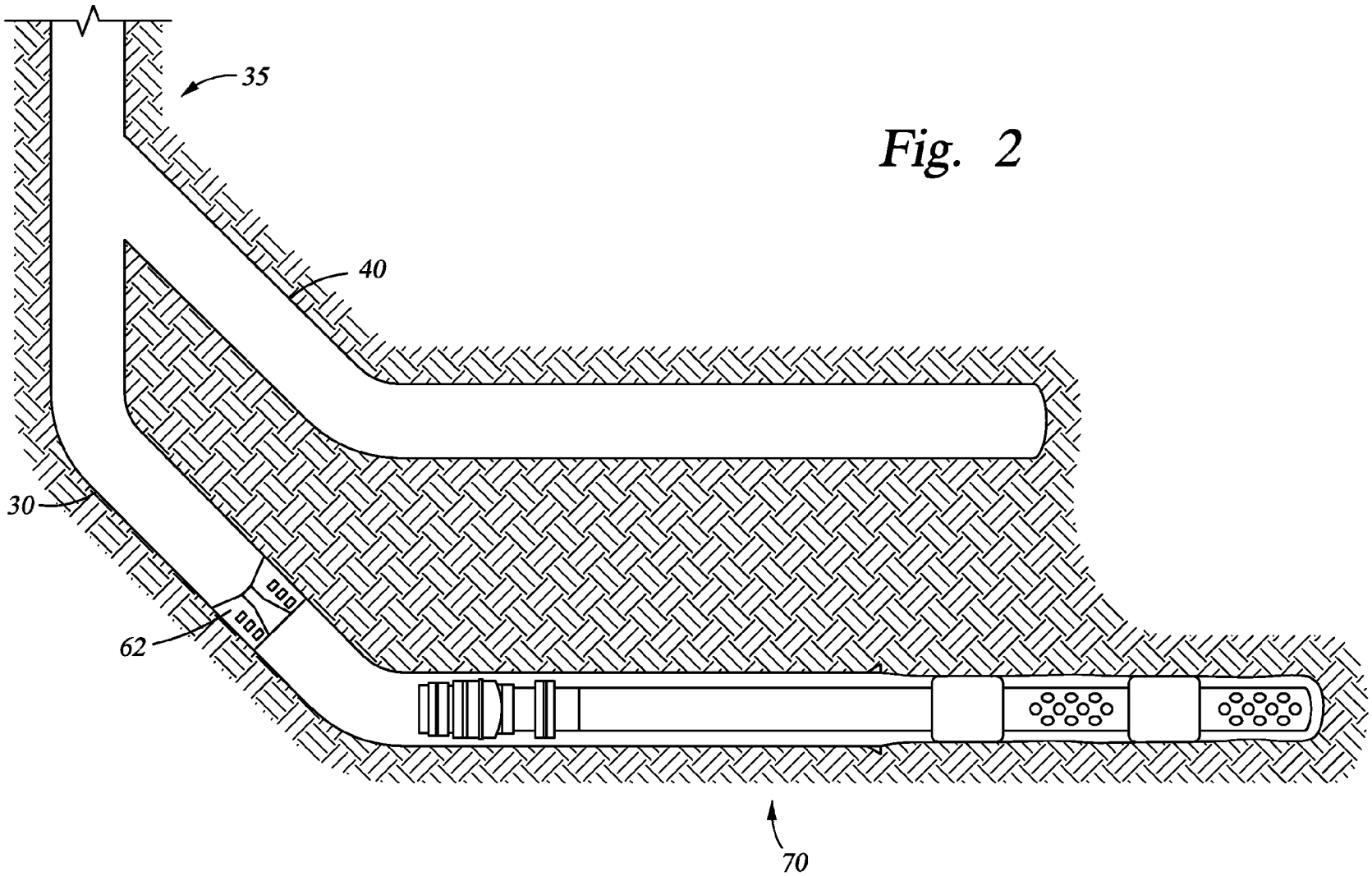
FIG. 2 is a schematic view of the finished junction between the lateral borehole and the primary borehole including downhole operations equipment.

Referring initially to FIG. 1, a primary or main borehole 30 is drilled in a conventional manner and may include operational equipment 60, such as a whipstock and anchor system, and 70, such as a fracturing or production system. A diverter or whipstock 45 is used to guide a milling and/or drilling assembly 50 laterally relative to the primary borehole 30 for creating a lateral or secondary borehole 40 having a junction 35 with the primary borehole 30. Referring now to FIG. 2, the finished junction 35 and lateral borehole 40 are shown. Well treatment, completion or production equipment 70 may remain in the primary borehole 30 along with an orientator or locator 62 for receiving additional downhole tools.

Figure 3:
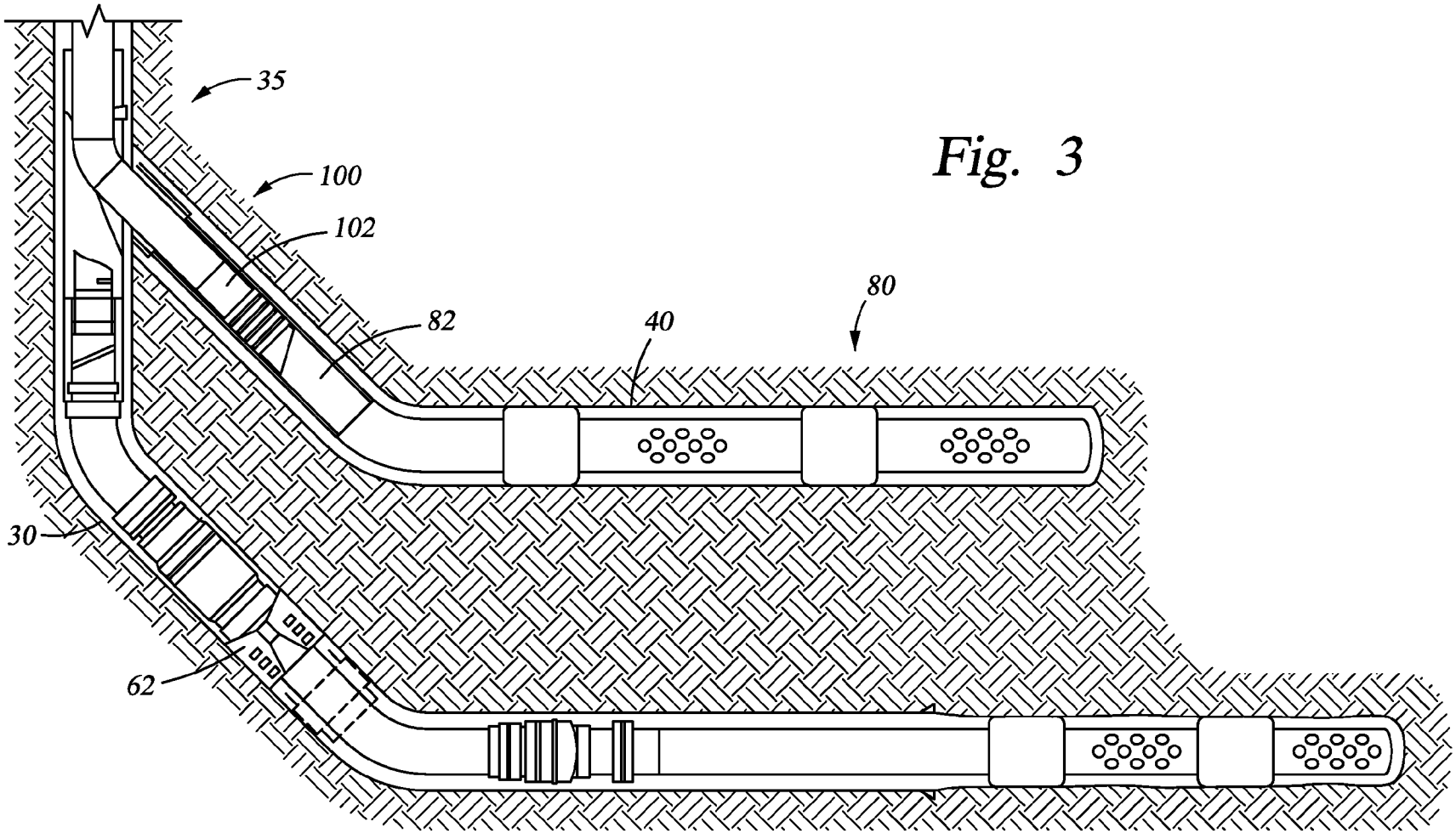
FIG. 3 is a schematic view of a multiple borehole tubing assembly in accordance with principles disclosed herein disposed in the junction of FIG. 2.
Figure 4:
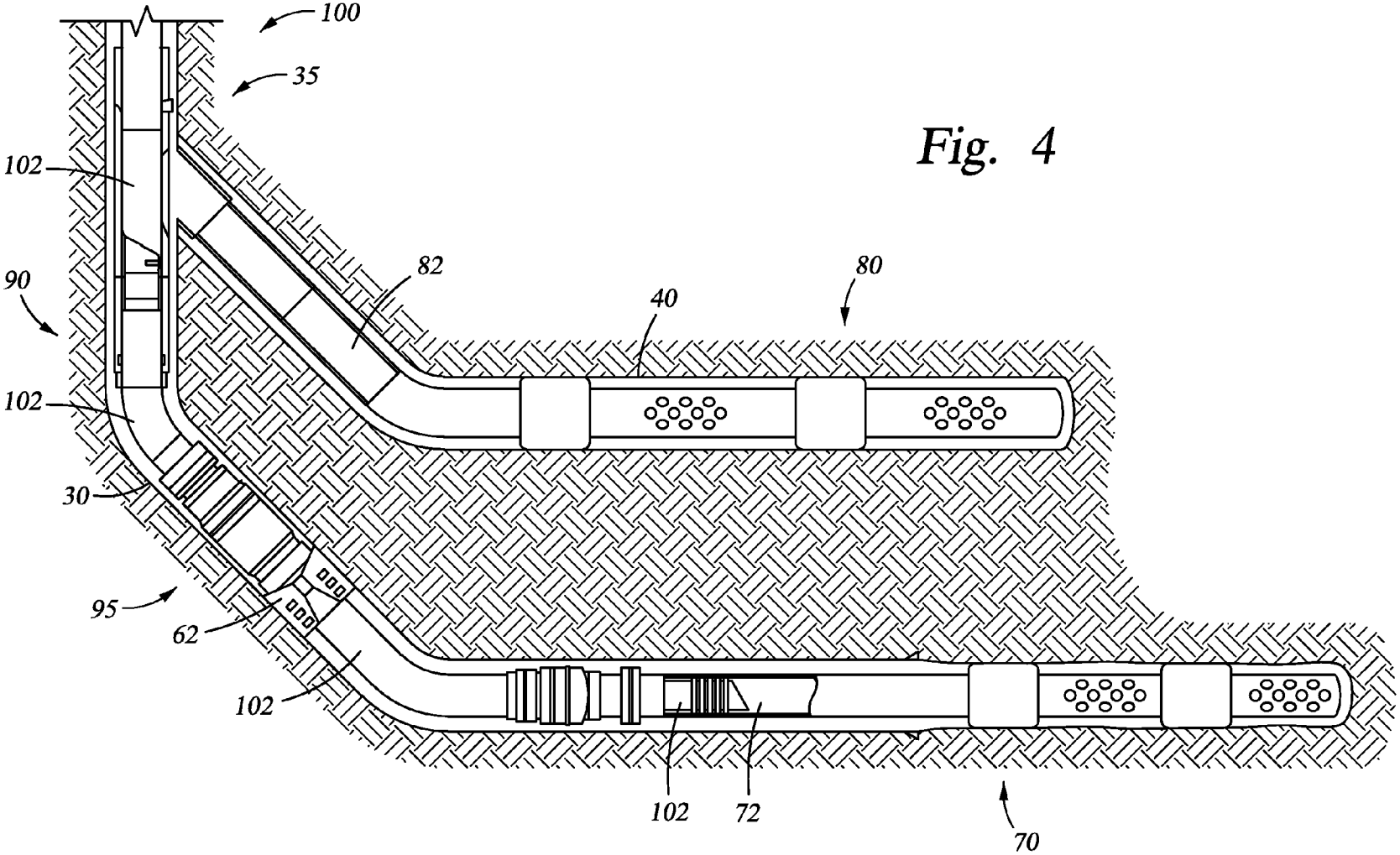
FIG. 4 is a view of the tubing assembly of FIG. 3 in another position.

Referring next to FIG. 3, a tubing system or assembly 100 is shown in accordance with the principles of the present disclosure. The tubing assembly 100 is adapted for entry of a primary tubular member 102 into multiple boreholes, such as the lateral borehole 40 and the primary borehole 30, during a single trip of the assembly 100 into the wellbore. As shown in FIG. 3, the tubular member 102 is selectively inserted into the lateral borehole 40 for further downhole operations, such as delivering additional tools or providing a treatment or fracturing fluid to the downhole system 80 via a receptacle 82. Then, as shown in FIG. 4, the tubular member 102 may be selectively removed from the lateral borehole 40 and into the junction 35 for subsequent insertion into the primary borehole 30. As the tubular member 102 is advanced into the primary borehole 30, an upper assembly 90 and an intermediate assembly 95 guide the tubular member 102 to a receptacle 72 in the system 70. In some embodiments, the upper assembly 90 includes main bore and lateral bore junction blocks. In some embodiments, the junction blocks include a deflector and seals. For example, a level five junction includes sealed production paths. In some embodiments, the system 70 is a treatment or fracturing system for receiving fluids from the tubular member 102. Thus, as will be shown in more detail below, an assembly is provided for entry of a tubular member into multiple boreholes in a selective manner and in a single trip into the primary borehole 30 above the junction 35.

Figure 5:
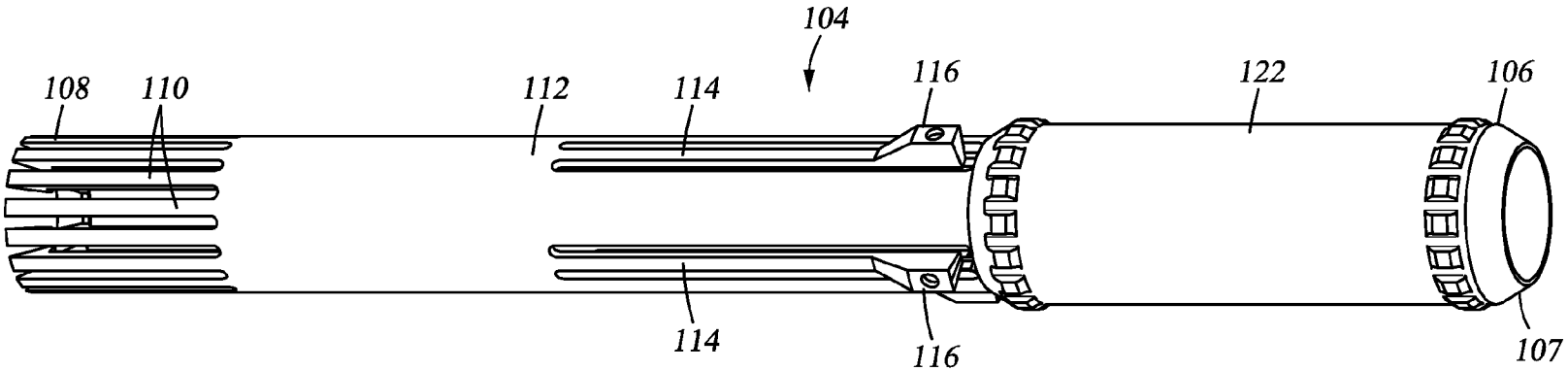
FIG. 5 is a perspective view of a tubing shroud of a multi-bore tubing assembly in accordance with principles disclosed herein.
Figure 6:
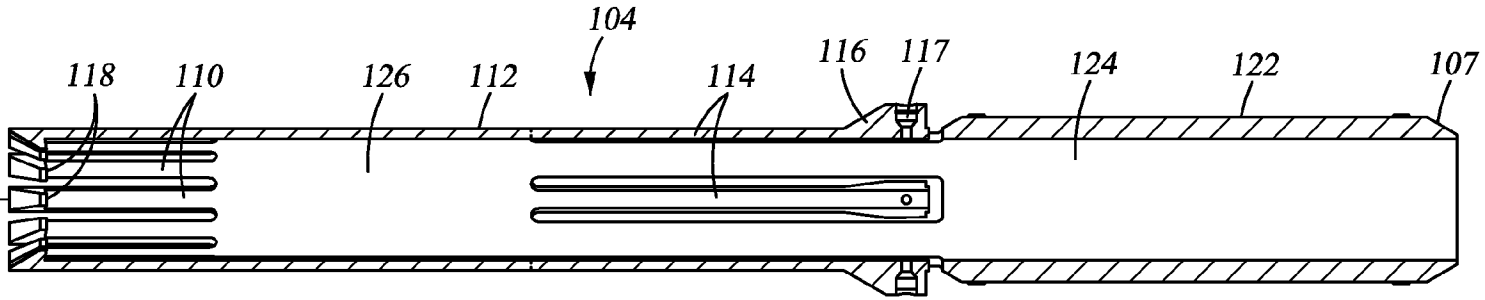
FIG. 6 is a cross-section view of the tubing shroud of FIG. 5.

Referring to FIG. 5, a perspective view of a tubing shroud 104 is shown. The shroud 104 includes a first end 106 and a second end 108 for receiving the tubing 102. The first end 106 includes an increased diameter portion 122 and a tapered surface 107. The shroud 104 includes an intermediate portion 112 including a series of circumferentially disposed leaf springs 114. The leaf springs 114 each include an enlarged end 116. The end 108 includes a series of collets 110. Referring next to FIG. 6, a cross-section view of the shroud 104 is shown revealing additional details. The collets 110 include inner tapered engagement shoulders 118. The shroud 104 includes throughbores or passageways 124, 126. The leaf spring ends 116, also called latch dogs, include bores 117.

Figure 7:
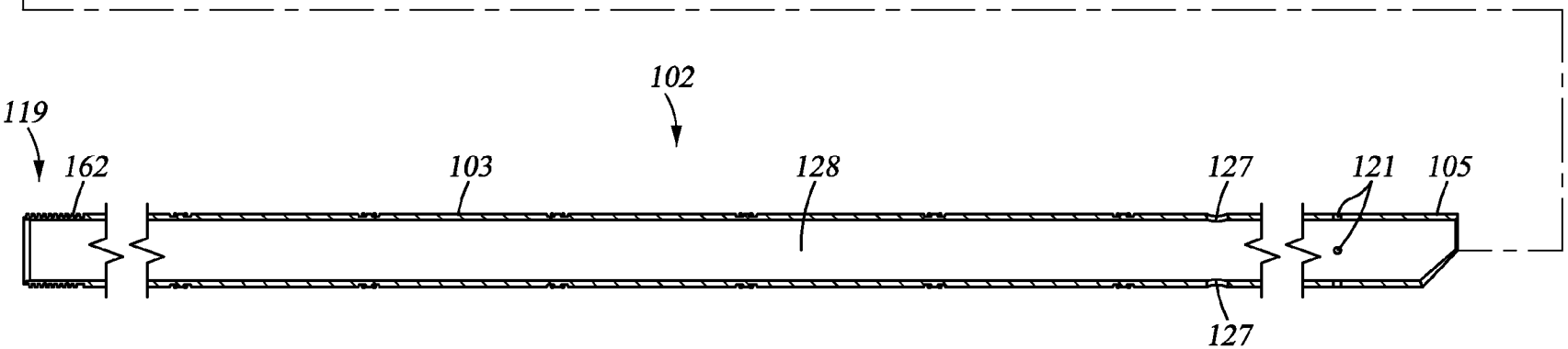
FIG. 7 is a cross-section view of a primary tubing of the multi-bore tubing assembly.

Referring to FIG. 7, the primary tubing 102 is shown in cross-section. A tubular member 103 includes a throughbore or passageway 128 and a lower or operating end 105. The tubular member 103 includes multiple holes or bores. A first circumferentially spaced set of bores 121 may receive securing members such as shear screws. In different embodiments, the bores 121 are disposed in various axial positions. A second set of circumferentially spaced holes 127 may be used as fluid ports. In exemplary embodiments, the ports 127 are disposed at various positions, such as above or below the bores 121. A portion 119 of the tubular 103 includes a connector 162, such as a pin end.

Figure 8:
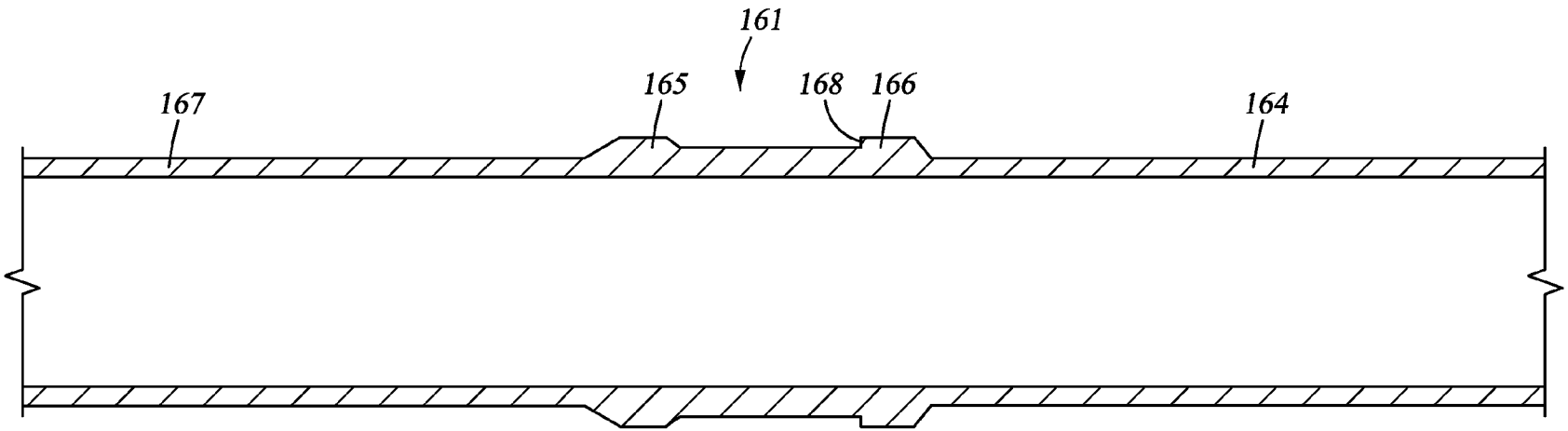
FIG. 8 is a cross-section view of a coupler of the multi-bore tubing assembly.

Referring to FIG. 8, a coupler 161 is shown in cross-section. The coupler 161 includes a connector 164, such as a box end, to couple to the connector 162 of the tubing 102. The coupler 161 includes an upper end 167 that couples to the upper tubing string that extends to the surface of the well. The coupler includes an intermediate, increased outer diameter portion having a dual tapered portion 165 and a tapered portion 166 including an upper shoulder 168.

Figure 9A:
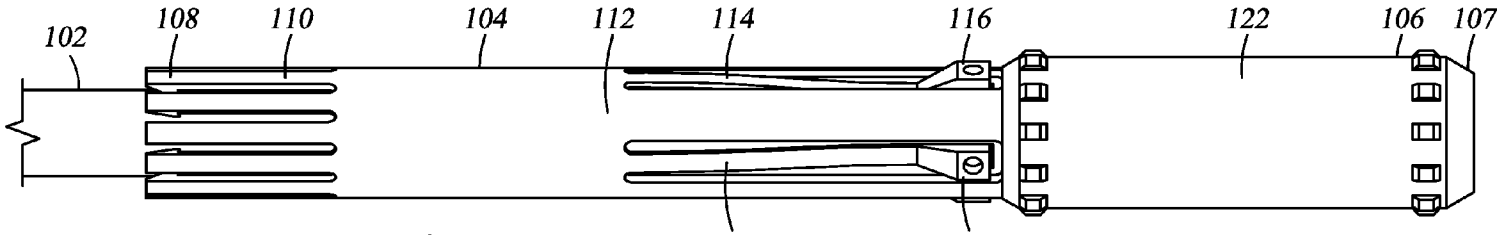
FIG. 9A is a side view of an embodiment of the multi-bore tubing assembly in an assembled position.
Figure 9B:
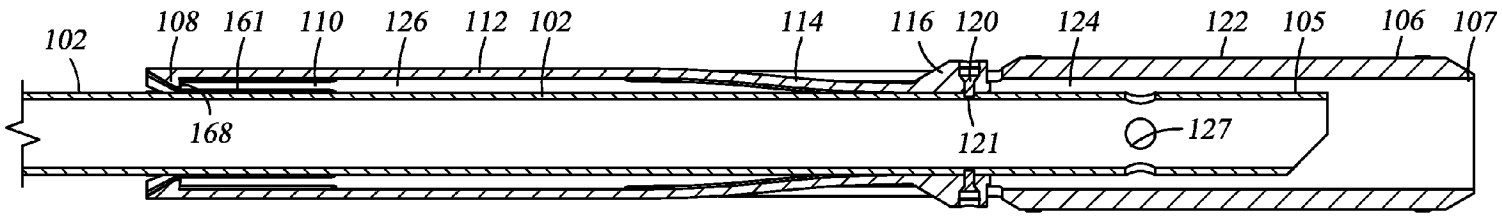
FIG. 9B is a cross-section view of the tubing assembly of FIG. 9A.
Figure 9C:
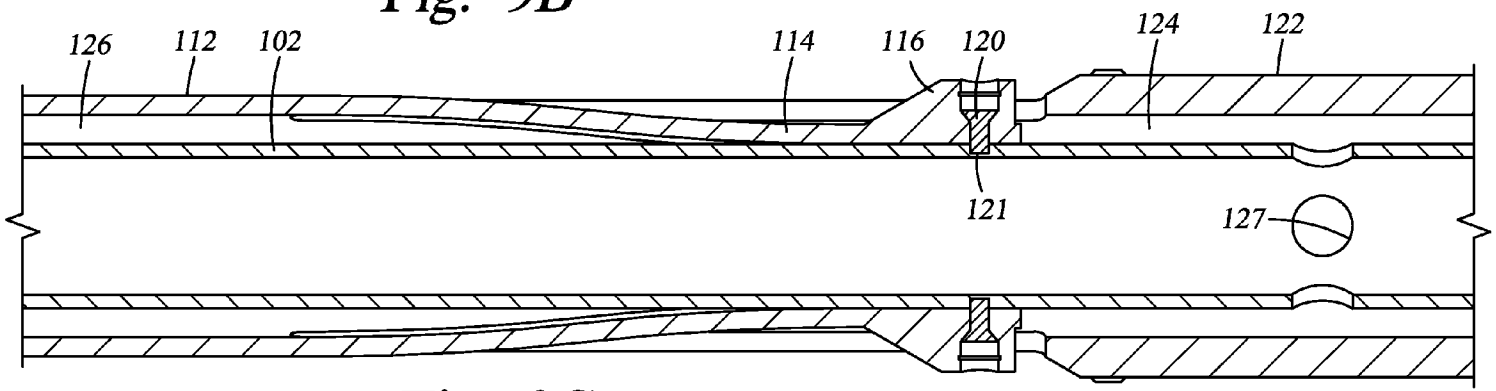
FIG. 9C is an enlarged view of a portion of the tubing assembly of FIG. 9B.

Referring now to FIGS. 9A-9C, different views of the selective multi-bore fracturing assembly 100 are shown with increased detail, while the assembly is in an assembled or run-in position. For simplicity and clarity in description, the assembly 100 will be discussed in the context of a fracturing operation though it is understood that there are other applications for a movable tubular member that can be controllably placed in multiple boreholes during a single trip downhole. In FIG. 9A, a side view of the tubing assembly 100 shows the primary tubing 102 surrounded by the shroud 104. The shroud 104 includes the first end 106 and the second end 108 for receiving the tubing 102. The first end 106 includes the increased diameter portion 122 and the tapered surface 107. The shroud 104 includes the intermediate portion 112 including the series of circumferentially disposed leaf springs 114. The leaf springs 114 each include the enlarged ends or latch dogs 116. The end 108 includes the collets 110.

Referring next to FIG. 9B, a cross-section of the tubing assembly 100 reveals that the end 105 of the tubing 102 resides in the throughbore 124 of the shroud 104. The ends 116 of the leaf springs 114 are secured to the tubing 102 by shear bolts 120. As shown in the enlarged view of FIG. 9C, the shear bolts are disposed through bores in the ends 116 and screwed into corresponding bores 121 in the tubing 102. This biases the leaf springs 114 radially inward toward the tubing 102. The intermediate portion 112 of the shroud 104 includes the throughbore 126. The collets 110 include the tapered engagement shoulders 118. The tubing 102 includes the increased diameter portions or engagement shoulders 168, or other snapping features, for retention engagement with the shoulders 118, as described more fully elsewhere herein. In some embodiments, the engagement shoulders 168 are part of the coupler 161 as previously described. In some embodiments, the end 105 of the tubing 102 includes ports 127 for fracturing or other fluid delivery or reception operations.

Figure 10A:
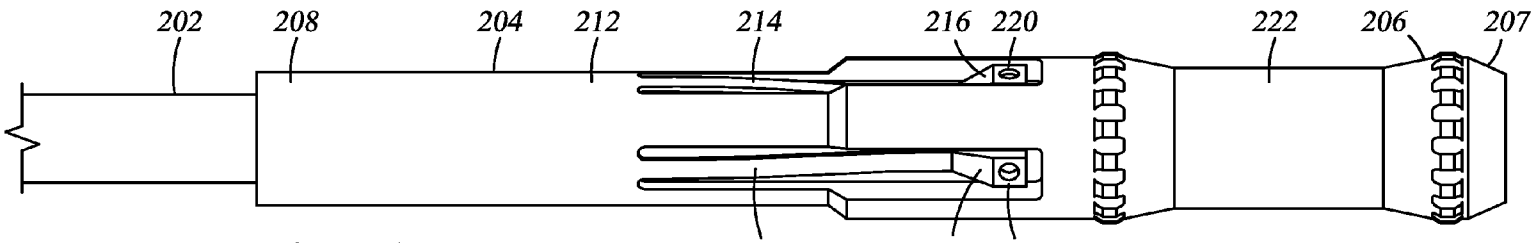
FIG. 10A is a side view of another embodiment of the multi-bore tubing assembly.
Figure 10B:
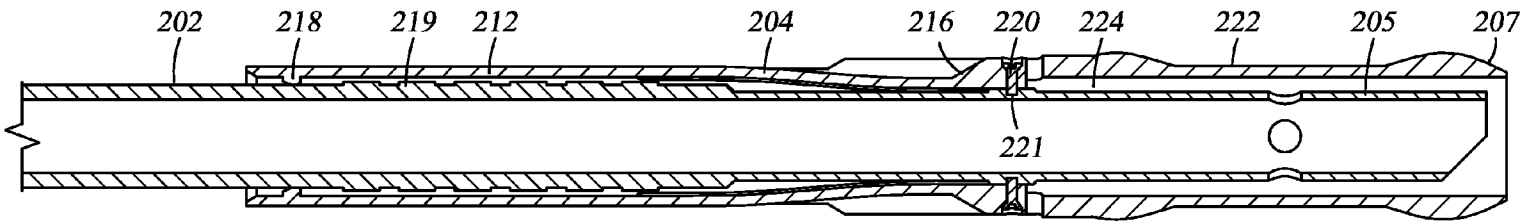
FIG. 10B is a cross-section view of the tubing assembly of FIG. 10A.
Figure 10C:
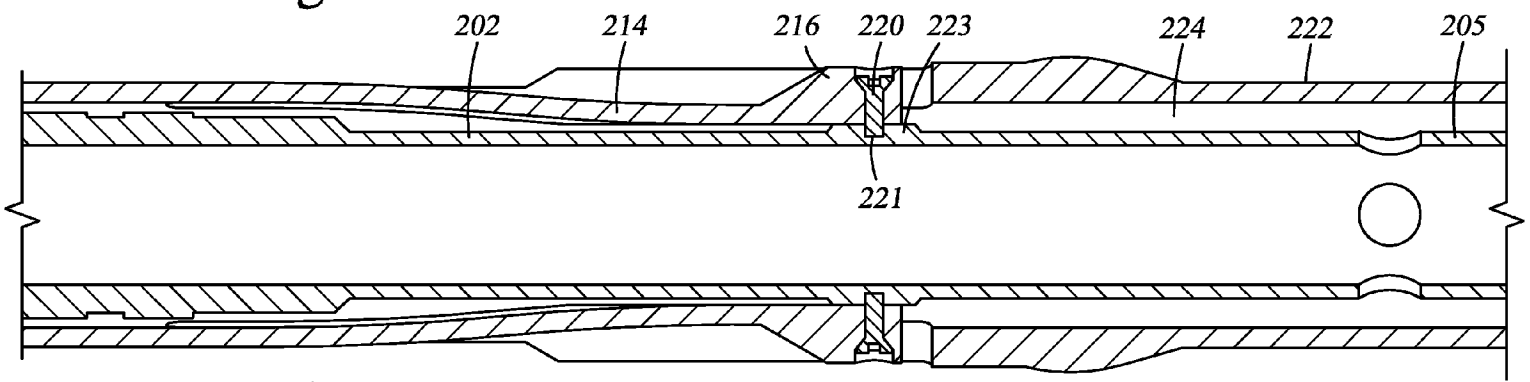
FIG. 10C is an enlarged view of a portion of the tubing assembly of FIG. 10B.

Referring now to FIGS. 10A-10C, another embodiment of a multi-bore tubular delivery system is shown as assembly 200. Generally, like parts in FIGS. 6A-6C are marked similarly to those parts in FIGS. 5A-5C for assembly 100. A shroud 204 may instead include a slightly reduced diameter portion 222 with ends 216 of the leaf springs 214 housed in an increased diameter body portion. An end 208 includes internal engagement shoulders 218. The tubing 202 includes retention members 219 for retaining engagement with the shoulders 218 as described elsewhere herein. As shown in FIGS. 10B and 10C, shear bolts 220 secure the leaf spring ends 216 to the tubing 202 at bores 221 in increased thickness portions 223. In some embodiments, the shear bolts 220 are not as recessed in the ends 216 as the shear bolts 120 are recessed in the ends 116.

Referring to FIGS. 11-36, operation of the tubing assembly 100 in the boreholes 30, 40 will be described in detail. In general, various stages of operation of the tubing assembly embodiments just described will be shown for application of the primary tubing to multiple bores while the assembly remains in or adjacent the wellbore junction during a single trip into the wellbore. The following description applies equally to the tubing assembly 200 and other embodiments consistent with the teachings herein.

Figure 11:
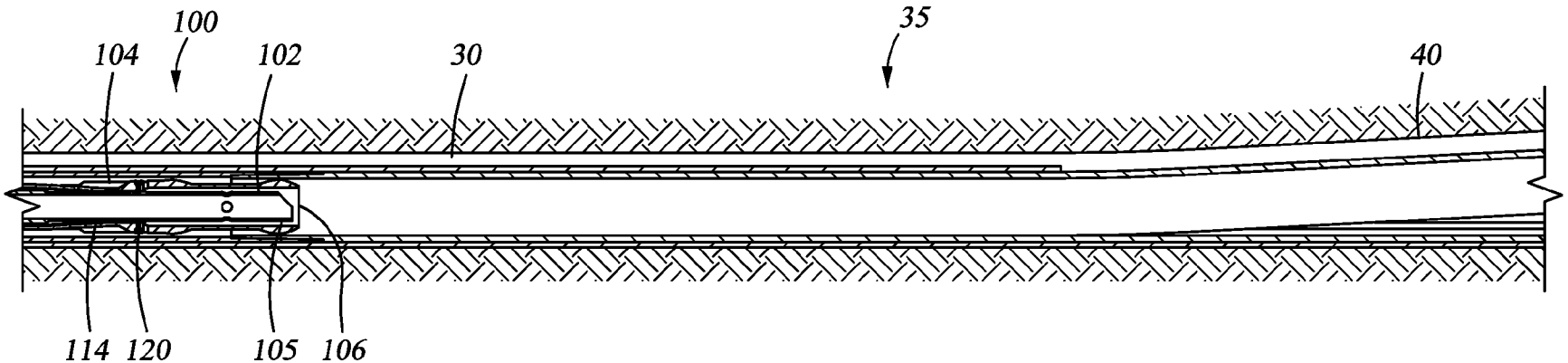
FIGS. 11-36 show various stages of operation of the tubing assembly embodiments for application of the primary tubing to multiple bores while the assembly remains in or adjacent the wellbore junction during a single trip into the wellbore.
Figure 12:
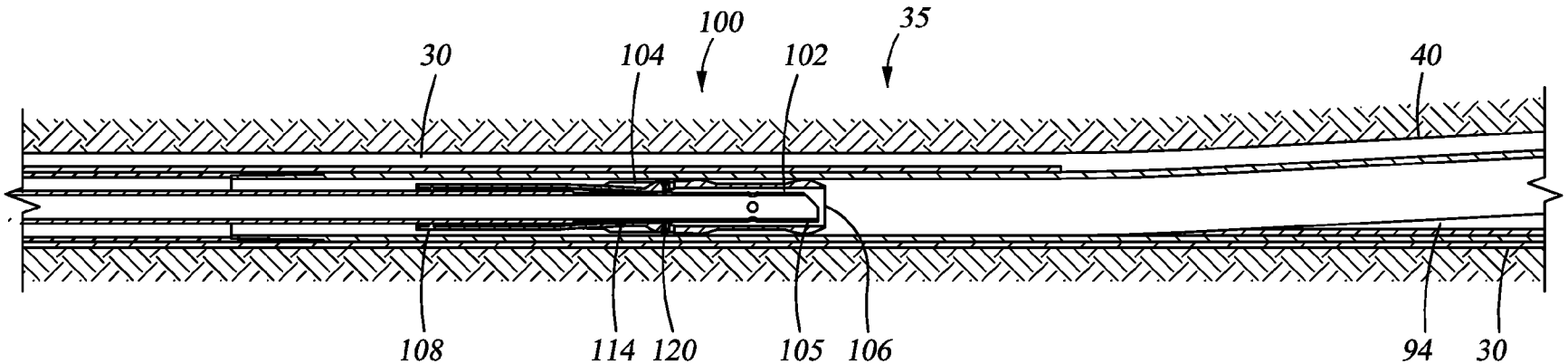

In FIG. 11, the assembly 100 is secured in its run-in or assembled position as shown in FIGS. 9A-9C, wherein the shroud 104 is coupled to the tubing 102 by the shear bolts 120 and the leaf springs 114. The assembly 100 is lowered through the primary borehole 30 using the tubing 102 and other tubing strings or conveyances coupled thereto. The leading end 106 of the shroud 104 protects the end 105 of the tubing 102. The assembly is advanced toward the junction 35, as shown in FIG. 12, toward a deflector 94 anchored in the primary borehole 30 adjacent the junction 35. In some embodiments, the deflector 94 is a component of the main bore junction block.

Figure 13:
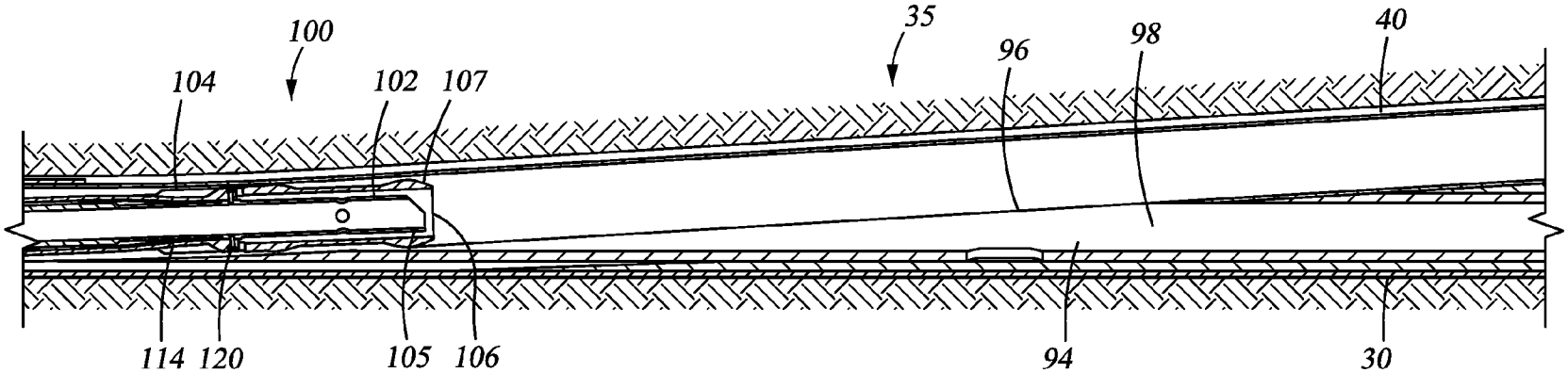
Figure 14:
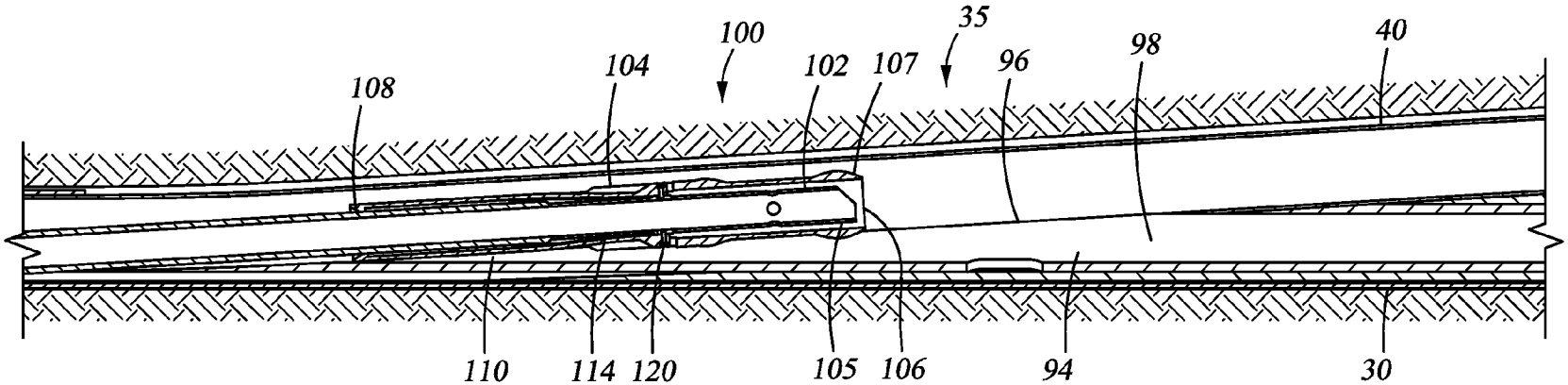

In the enlarged view of the junction 35 in FIG. 13, the assembly 100 is shown advanced to the point of contact between the leading end 106 of the shroud 104 and the deflector 94. The deflector 94 includes a ramp 96 and an axial throughbore 98 with an inner diameter. The leading end 106 includes the tapered surface 107 that extends outwardly to an outer diameter of the shroud 104. The outer diameter of the shroud 104 is greater than the inner diameter of the deflector bore 98 such that the shroud 104 and assembly 100 are not allowed to pass through the deflector 94 and into the main borehole 30. Instead, the tapered surface 107 engages the ramp 96, and the mating surfaces slide relative to each other to guide the shroud 104 and the assembly 100 toward the lateral borehole 40, as shown in FIG. 14.

Figure 15:
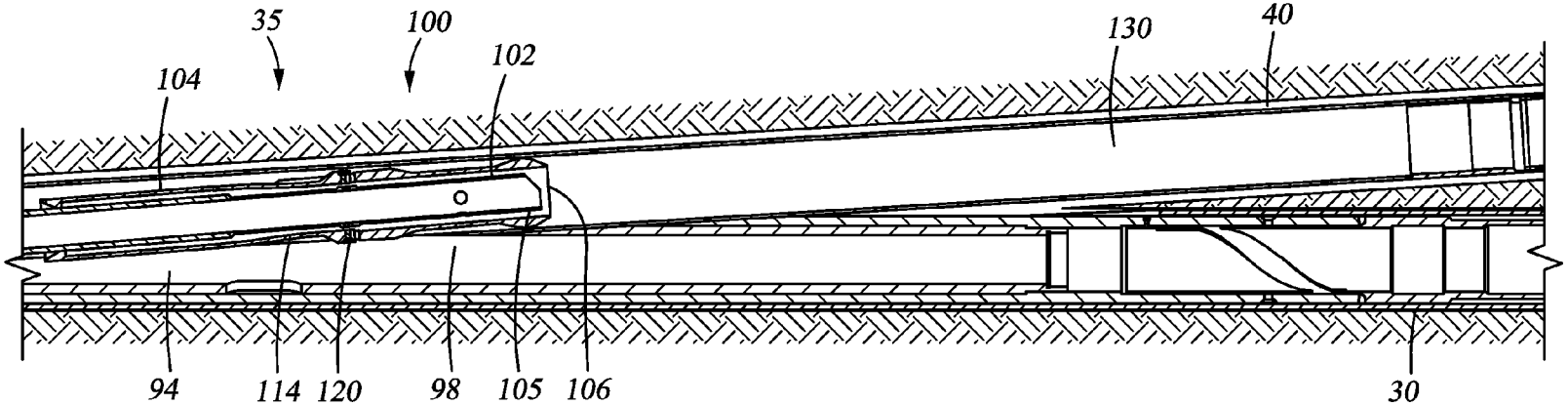
Figure 16:
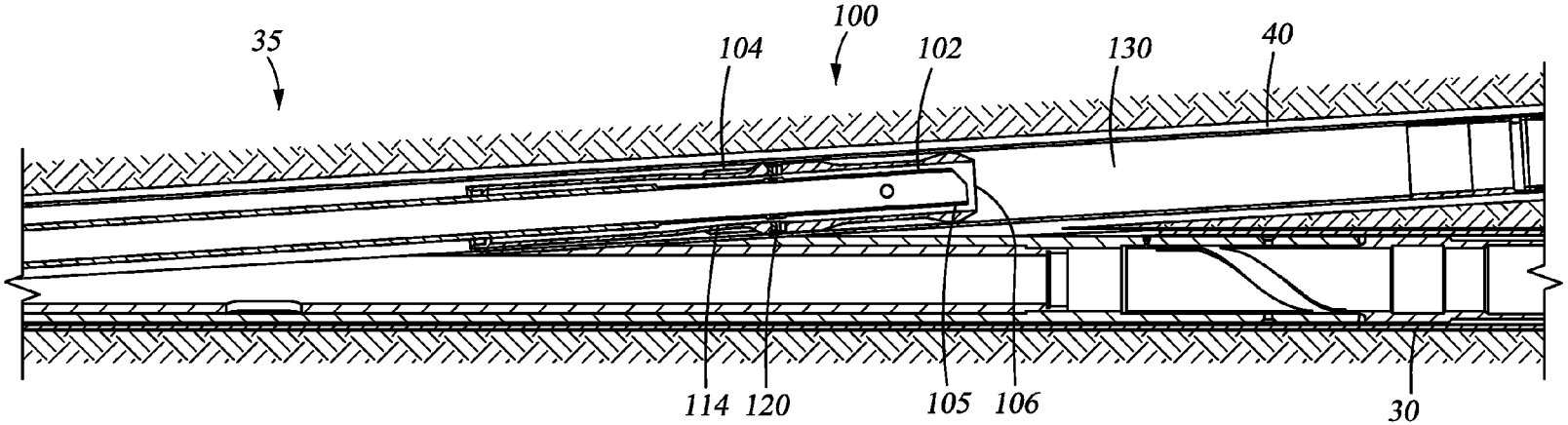
Figure 17:
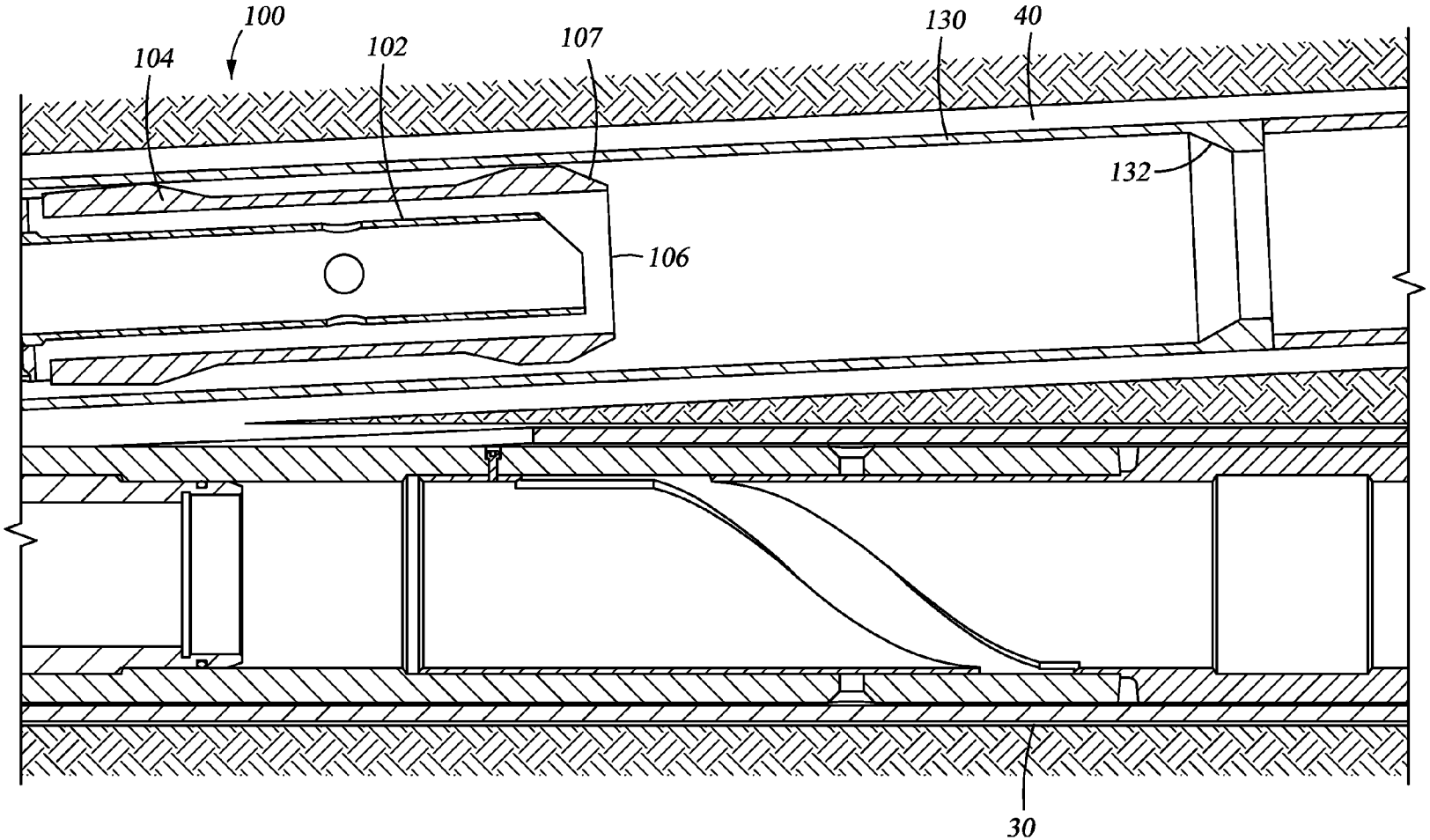
Figure 18:
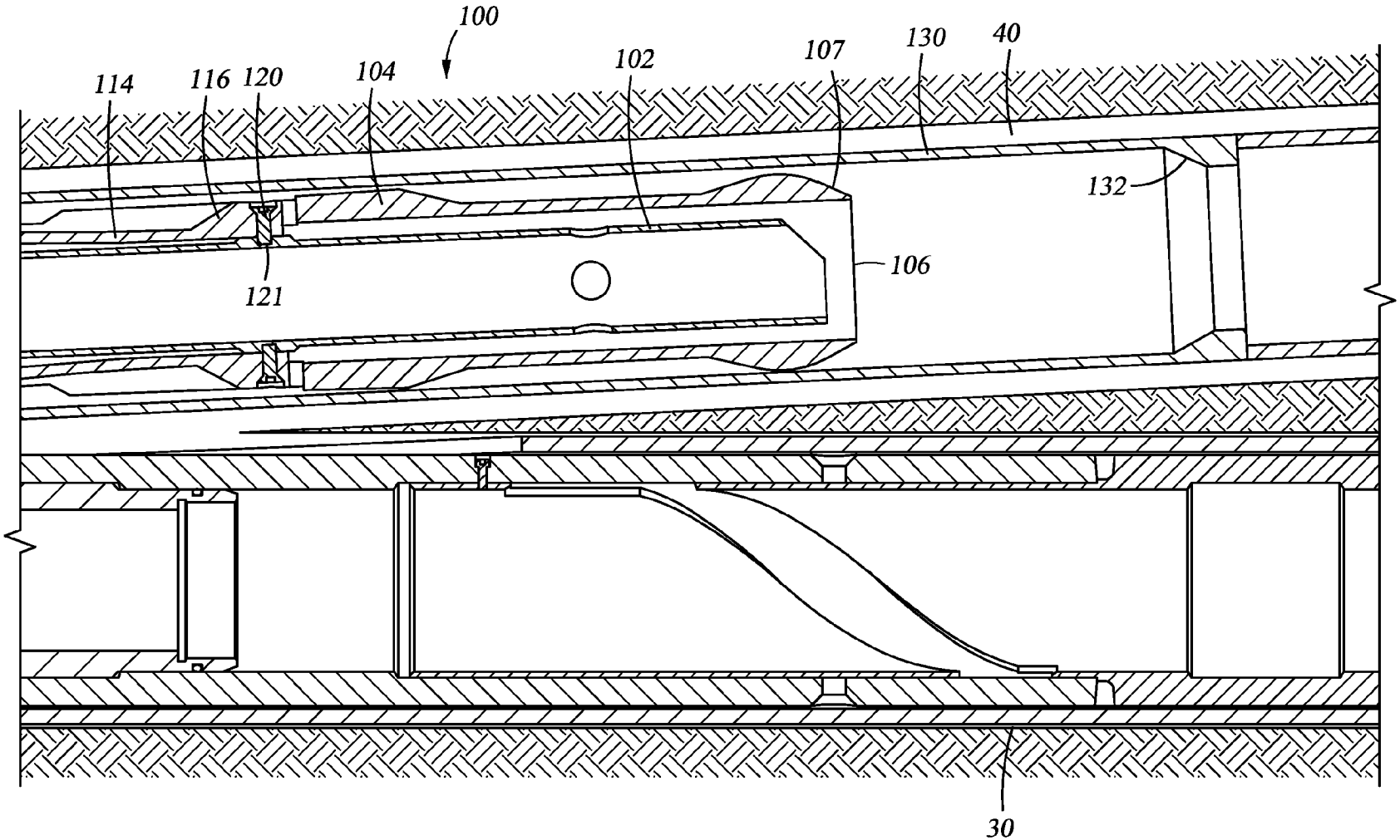
Figure 19:
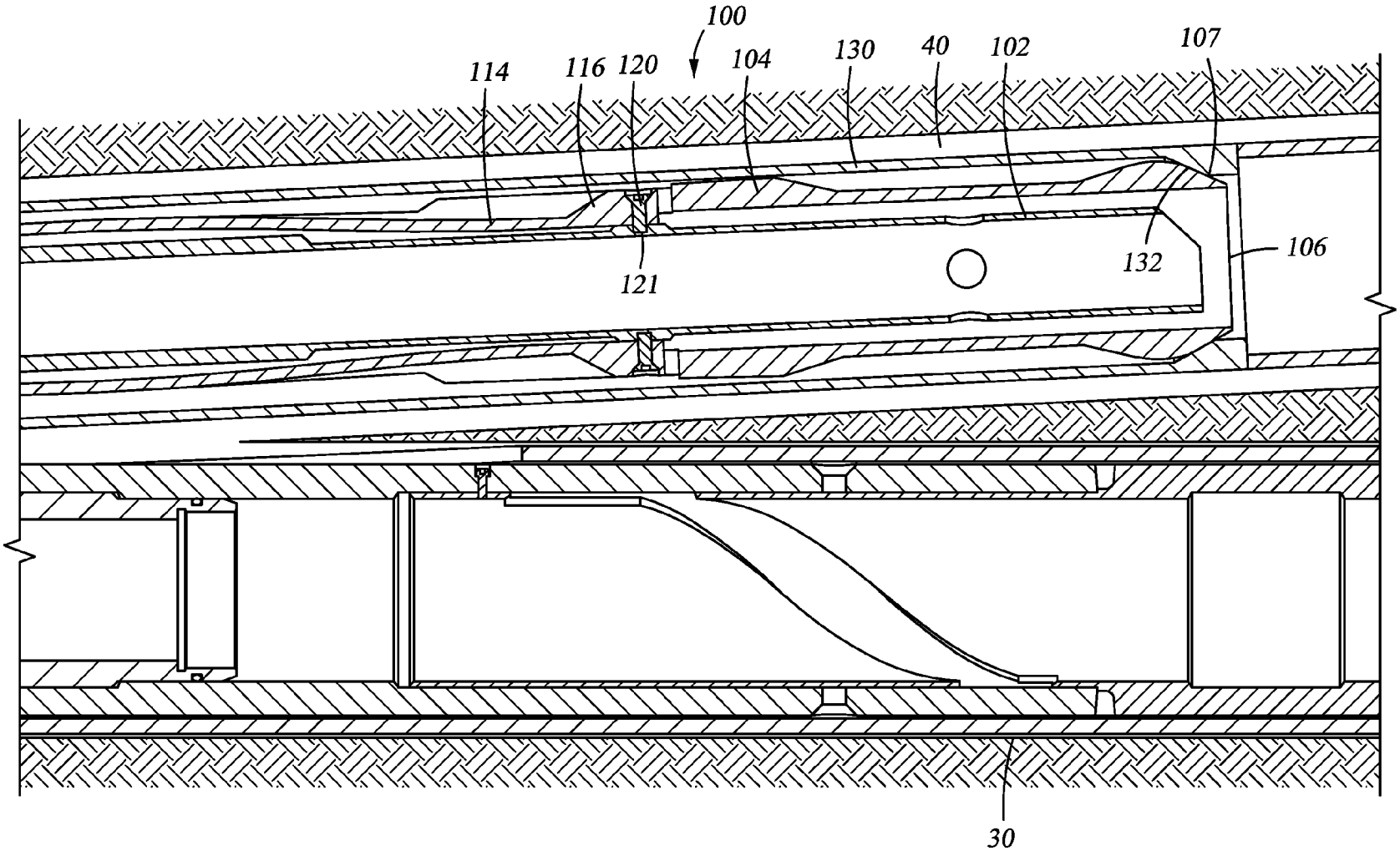
Figure 19A:
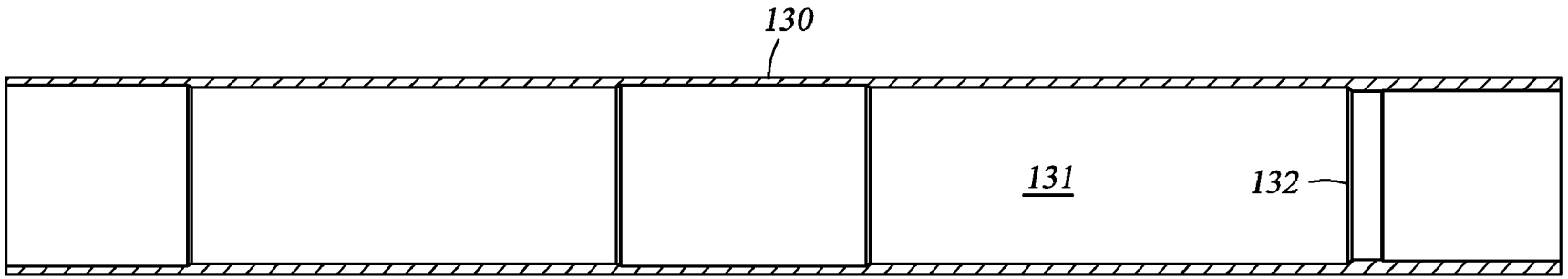

Referring now to FIG. 15, the leading end 106 of the shroud 104 has been deflected from the deflector 94 and into a receptacle 130 in the lateral borehole 40. The shroud 104 and the assembly 100 continue to be supported and advanced by the tubing 102 into the receptacle 130, as shown in FIG. 16. In FIG. 17, an enlarged view shows that the receptacle 130 includes a lower seat 132 with a tapered shoulder. The assembly 100 continues to advance until the leading tapered surface 107 of the end 106 engages the tapered seat 132, as shown in FIGS. 18 and 19. This action lands the shroud 104 and the assembly 100 in the lateral borehole 40. Referring to FIG. 19A, an isolated, cross-section view of the receptacle 130 is shown. The tubular body includes a central bore or passageway 131 and the inner, lower shoulder 132 for receiving or landing the shroud 104.

Figure 20:
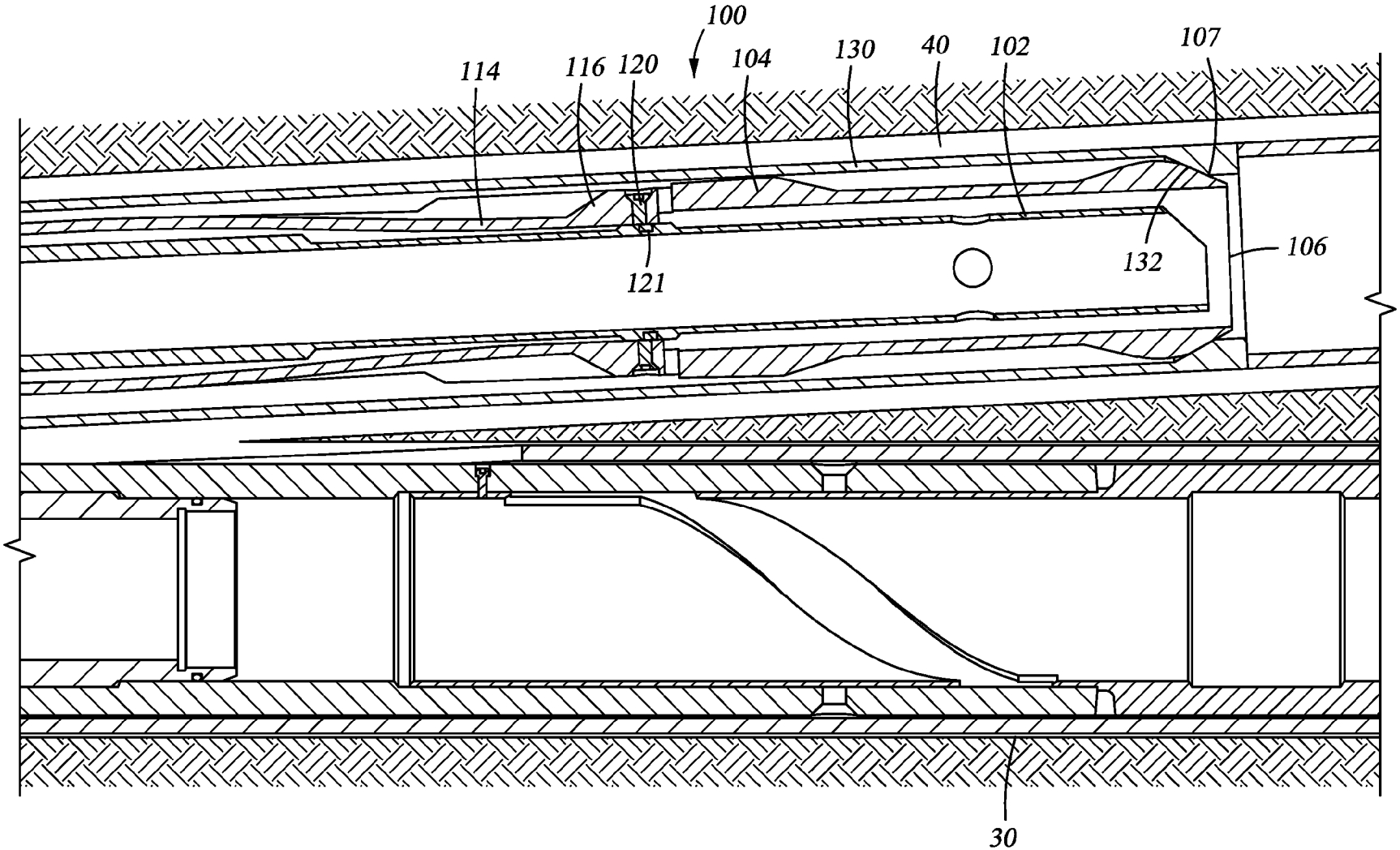
Figure 21:
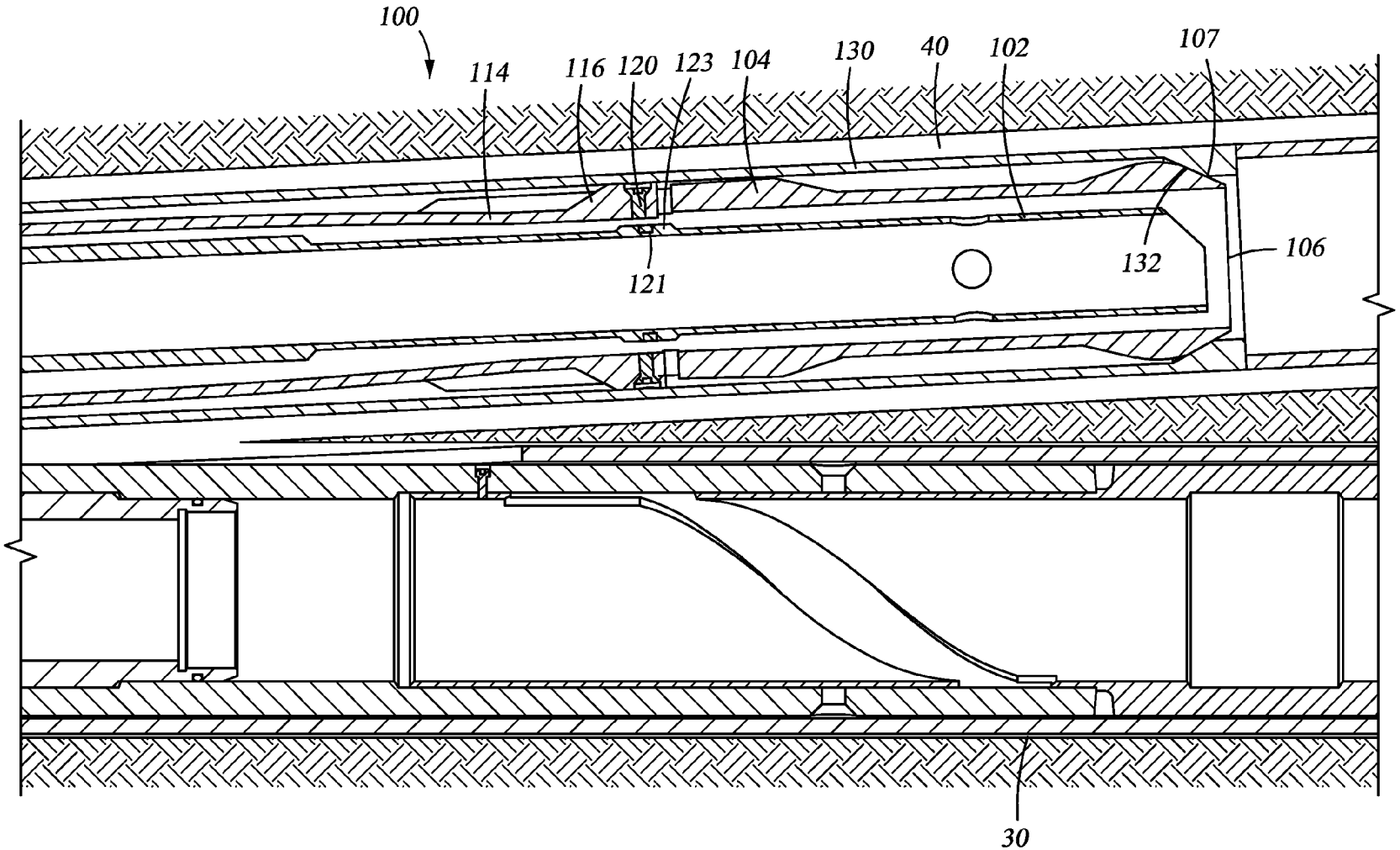
Figure 22:
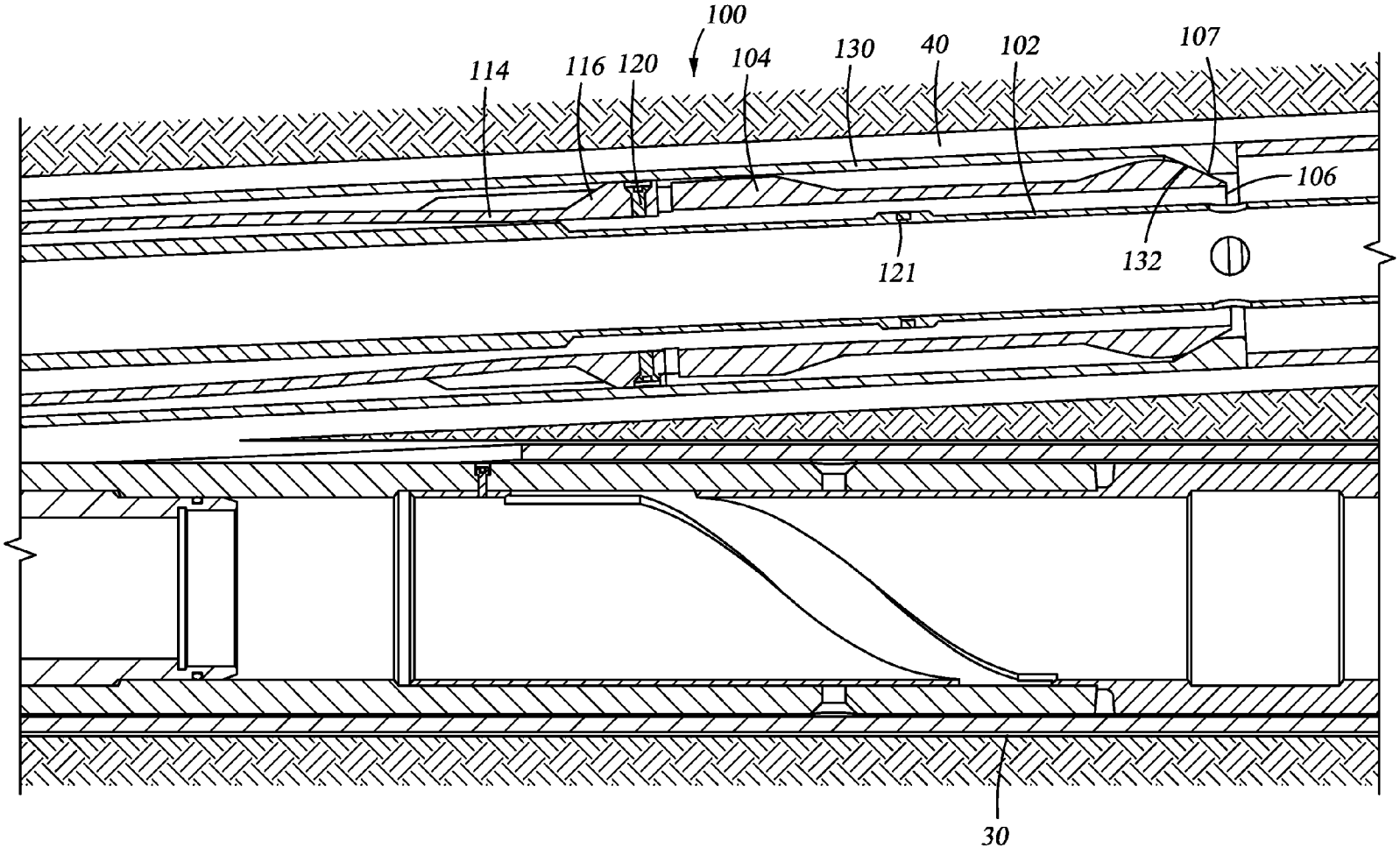

Next, as shown in FIG. 20, weight is applied downwardly on the tubing 102 causing the shear bolts 120 to shear, leaving inner portions of the bolts 120 in the tubing bores 121. The leaf springs 114 are now released to deflect radially outward, as shown in FIG. 21, such that the ends 116 contact the inner surface of the receptacle 130 and gaps 123 are formed between the shroud 104 and the tubing 102. The tubing 102 is now de-coupled from the shroud 104. Now, the tubing 102 is advanced free of and relative to the shroud 104 while the seat 132 in the receptacle 130 continues to retain the shroud 104, as shown in FIG. 22.

Figure 23:
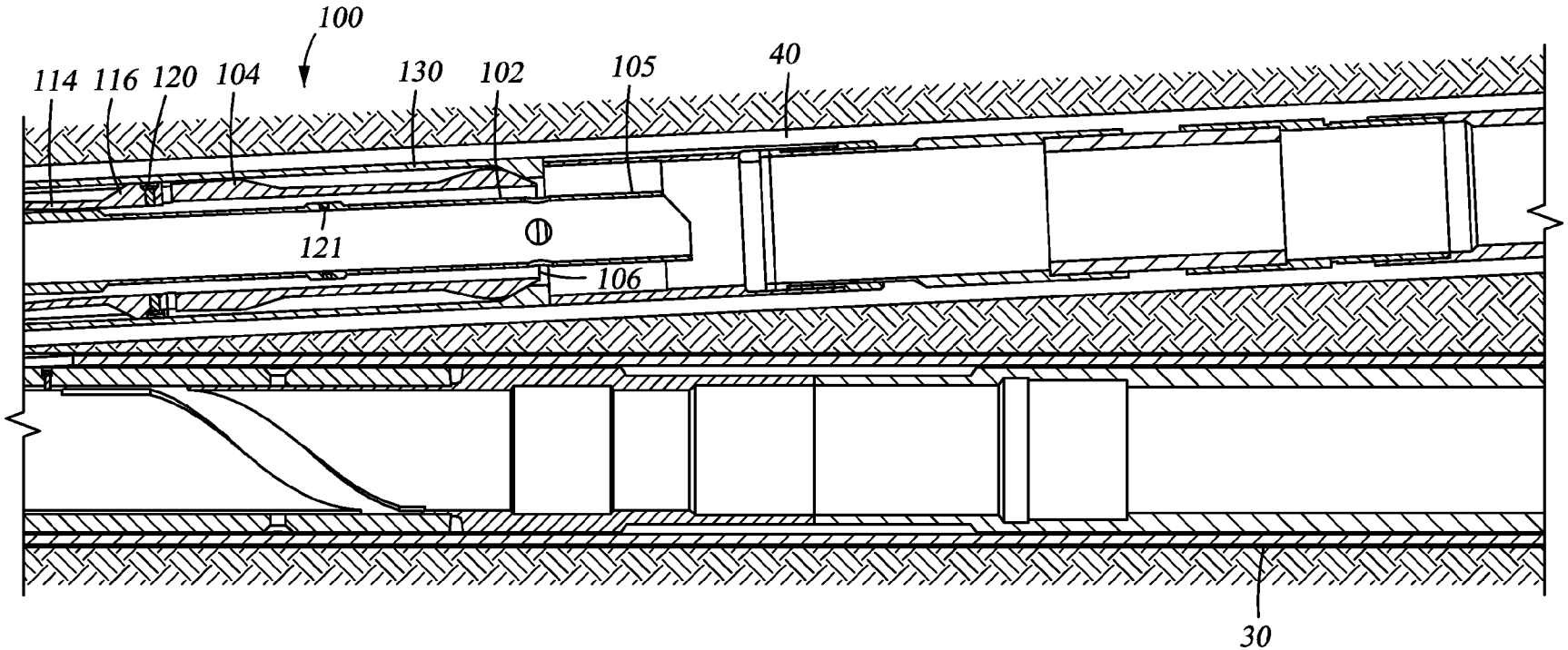
Figure 24:
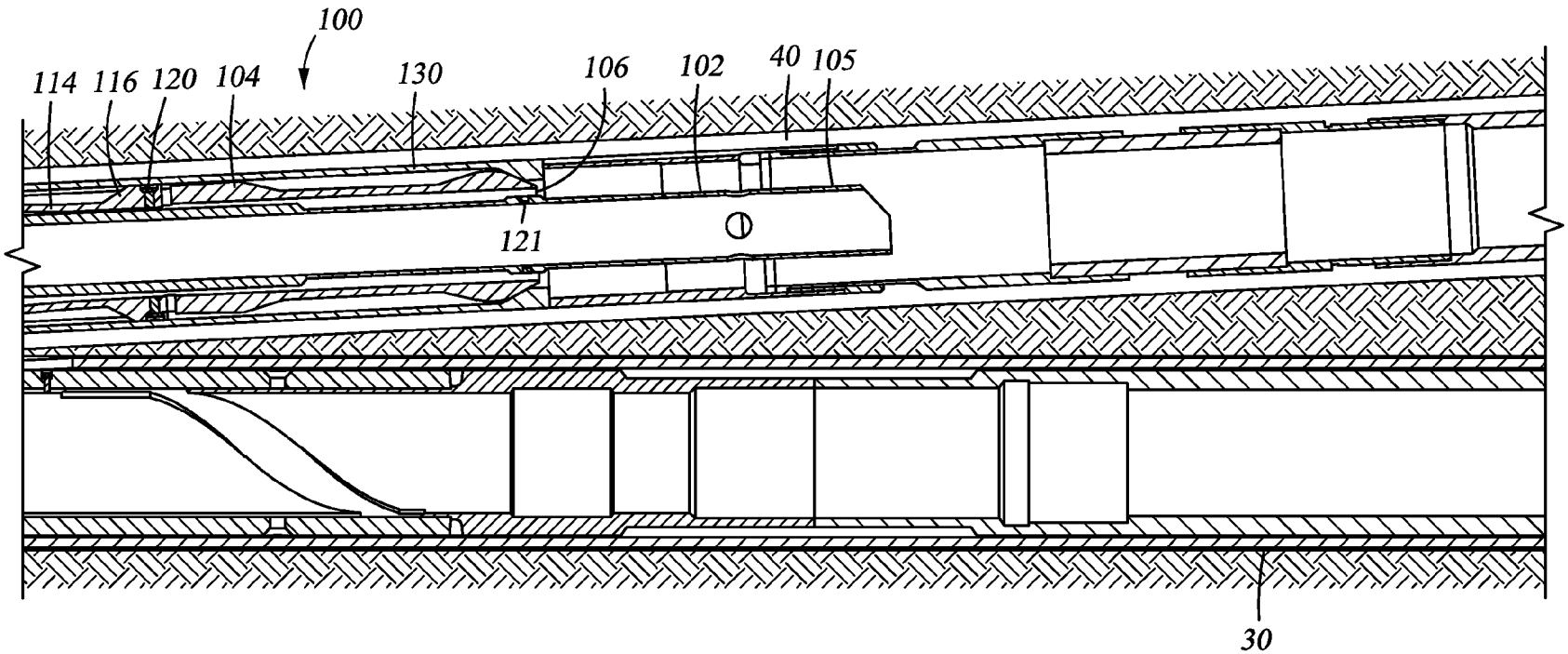
Figure 25:
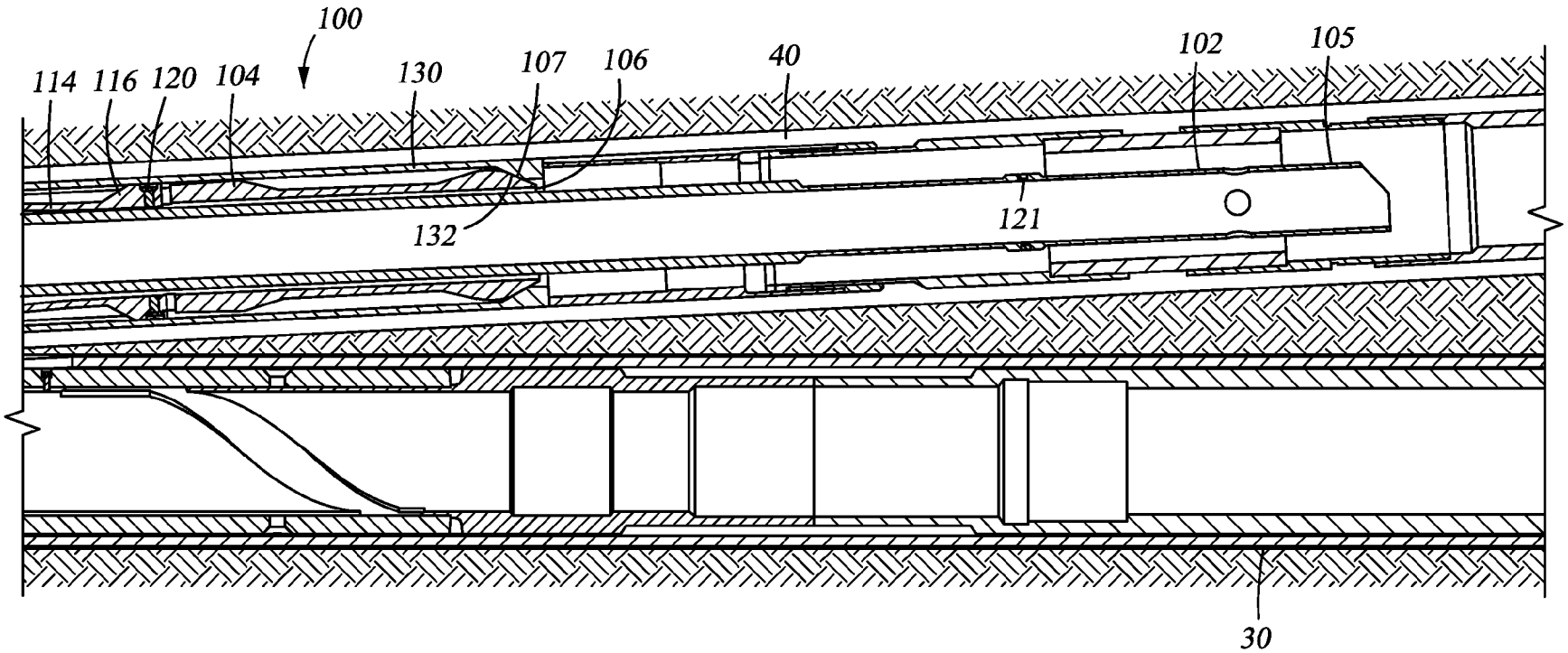
Figure 26:
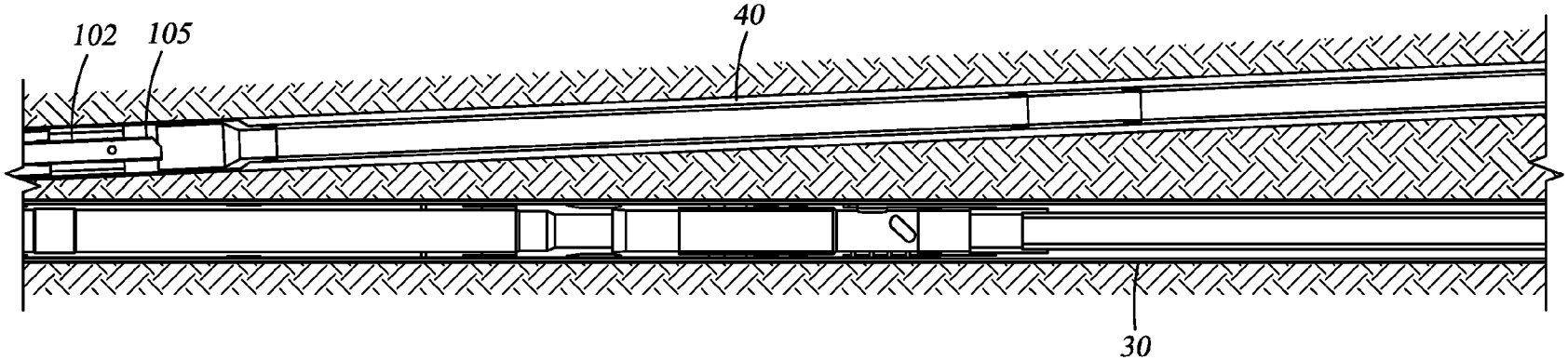
Figure 27:
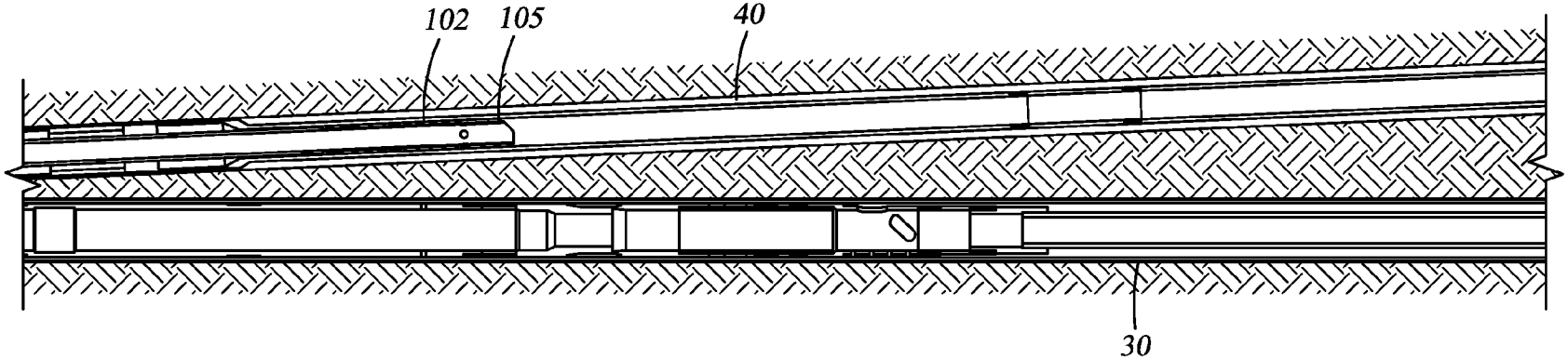

Referring to FIG. 23, the operating end 105 of the fracturing tube 102 is shown advanced out of the protective end 106 of the shroud 104. The tube 102 is no longer restrained by the shroud 104, so it can be extended as far as needed into the lateral borehole 40 to perform fracturing operations. Significant extension is provided by an upper portion of the tube 102 that extends to the surface of the well. FIGS. 24-28 show the fracturing tube 102 being advanced into and extending through various receptacles, tubes and equipment in the lateral borehole 40.

Figure 28:
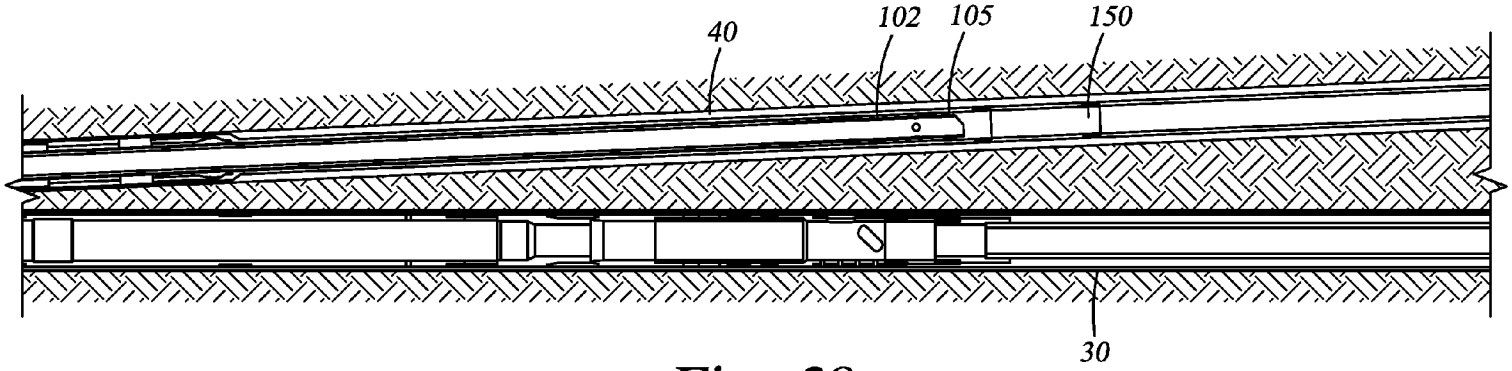
Figure 29:
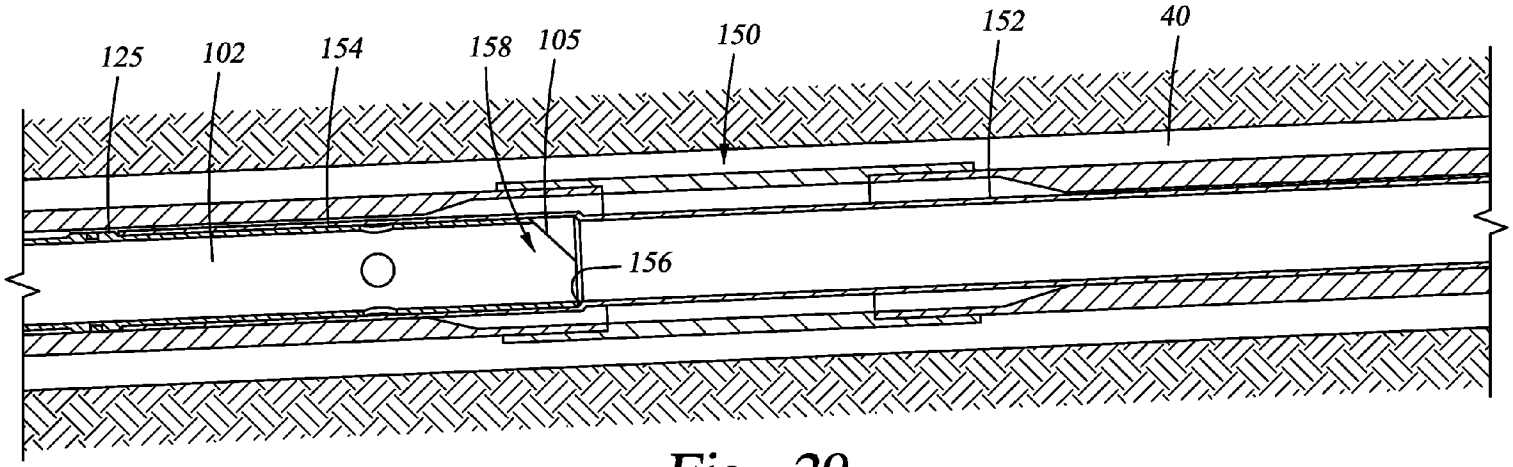

In some embodiments, the end 105 of the tubing 102 advances toward a mating device 150, as shown in FIG. 28. In the enlarged view of FIG. 29, the mating device 150 is a polished bore protector having a lower tubular portion 152 and an upper tubular portion 154. The upper tubular portion 154 includes an increased diameter over the lower portion 152, creating a tapered shoulder or seat 156 for receiving the end 105. The end 105 of the tubing 102 shoulders on the seat 156 and the tubing 102 snaps into or otherwise couples to the upper portion 154 to form a connection 158. Raised portion 125 of the tubing 102 may also shoulder onto the upper end of the portion 154.

Figure 30:
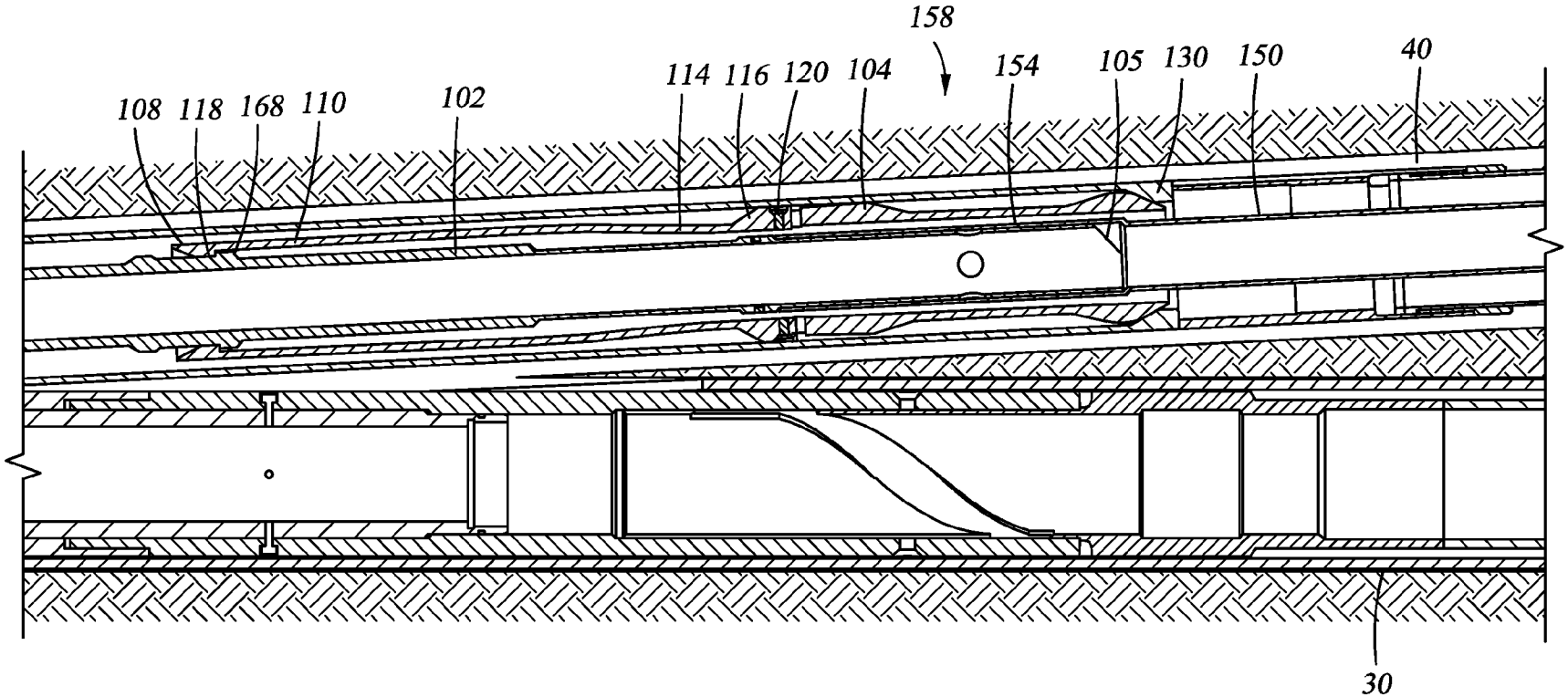
Figure 31:
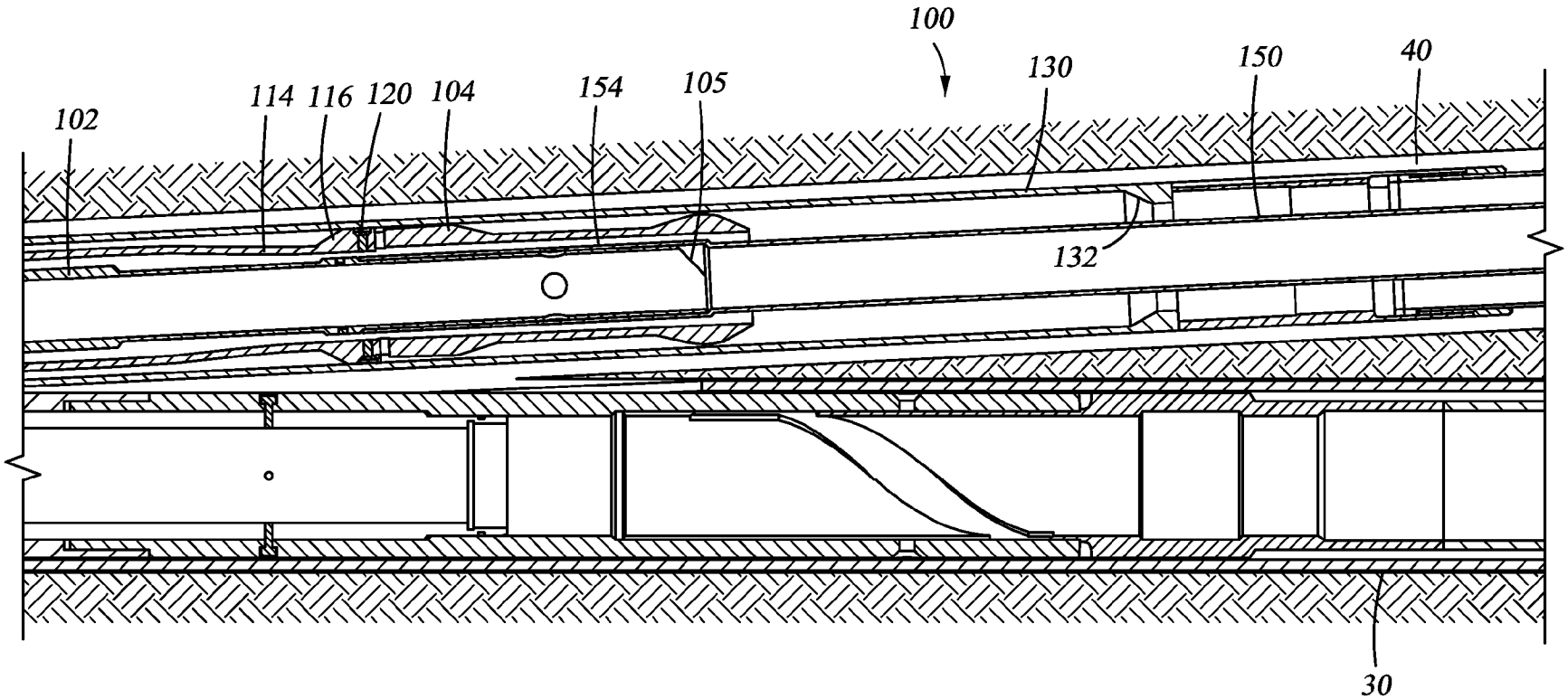

After fracturing or other downhole operations are complete, the tubing 102 and, in some embodiments, the polished bore protector 150 are pulled out of or retracted from the lateral borehole 40, as shown in FIG. 30. As previously noted, some embodiments include the polished bore protector 150 while others do not, leaving the operating end 105 of the tubing 102 exposed during this part of the process. When the tubing 102 reaches the position shown in FIG. 30, wherein the end 105 of the tubing 102 (and, in some embodiments, the connection 158) is adjacent the receptacle 130 and just below the junction 35, the engagement shoulder 168 catches on the engagement shoulder 118 at the end 108 of the shroud 104. Thus, the tubing 102 is prevented from moving further upward relative to the shroud 104, and the shroud 104 is pulled upward along with the tubing 102. As shown in FIG. 31, the tubing 102 and the shroud 104 once again form an assembly 100 which is pulled upward from the seat 132 in the receptacle 130.

Figure 32A:
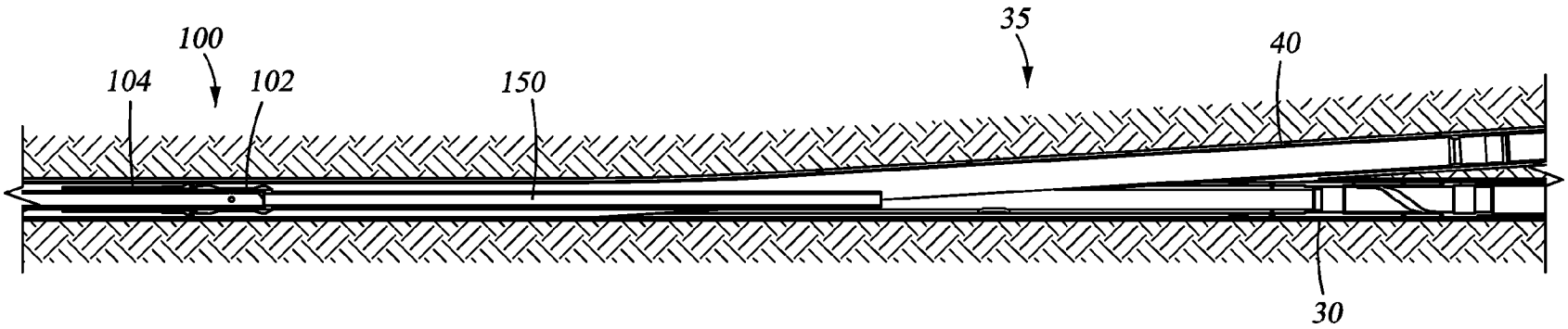
Figure 32B:
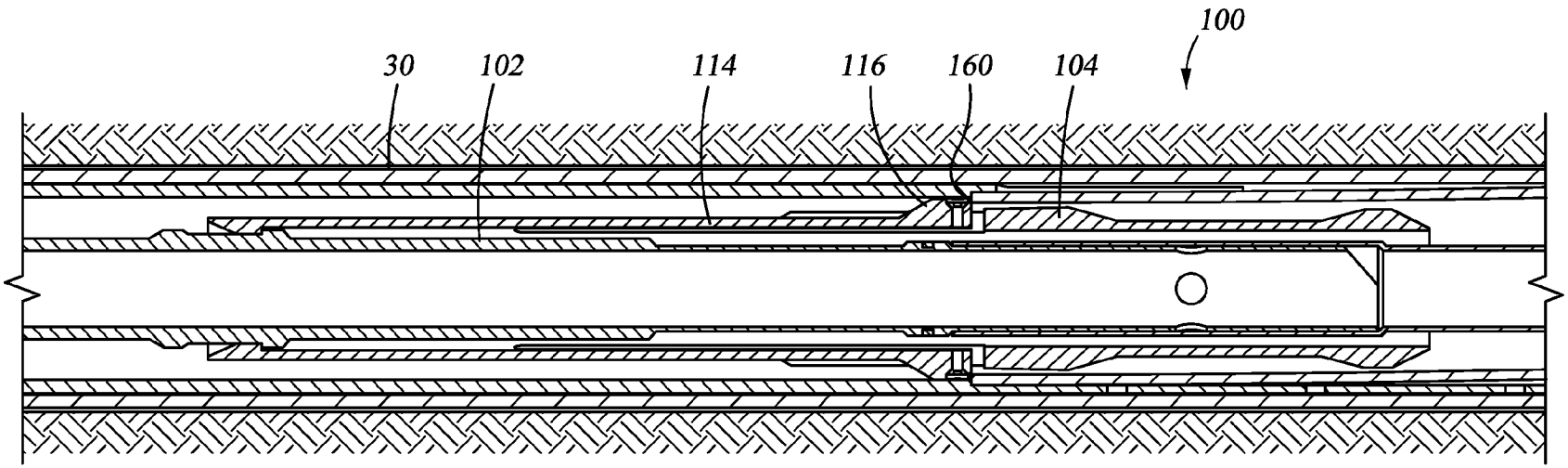

Referring to FIG. 32A, the assembly 100 is pulled upward until the assembly is removed from the lateral borehole 40 and the assembly 100 is positioned just above and adjacent the junction 35. In the embodiments where the tubing 102 is coupled to the polished bore protector 150, as shown, the protector 150 is also cleared of the lateral borehole 40 and the junction 35 into the main borehole 30. The leaf spring ends 116 are designed with an upper tapered surface such that when the assembly 100 is pulled upward, any projections or undercuts in the bore will slide along the tapered surface and press the leaf springs 114 to an inward position. The outwardly biased leaf springs 114 will spring back to an outer position once the projection or undercut has passed. The leaf spring ends 116 are also provided with squared or angled lower surfaces such that when the assembly 100 is lowered or advanced downward, the outwardly biased leaf springs 114 will catch on the projection or undercut. Thus, an undercut or shoulder 160 is provided in the main bore 30 above the junction 35. The leaf springs 114 and ends 116 will catch on the shoulder 160, as shown in FIG. 32B, as the assembly 100 is lowered slightly from the position shown in FIG. 32A. The shroud 104 is now retained and secured in the main bore 30 above the junction 35. The snap-acting leaf springs 114 prevent re-entry of the shroud 104 into the junction 35 by providing an adjustable outer diameter of the shroud 104 that, when released outwardly, catches on the shoulder 160.

Figure 33:
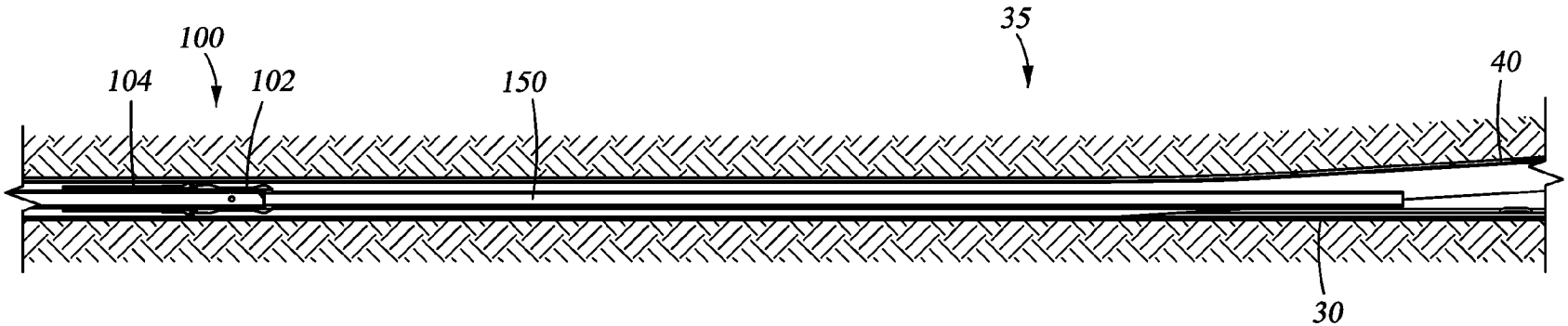
Figure 34:
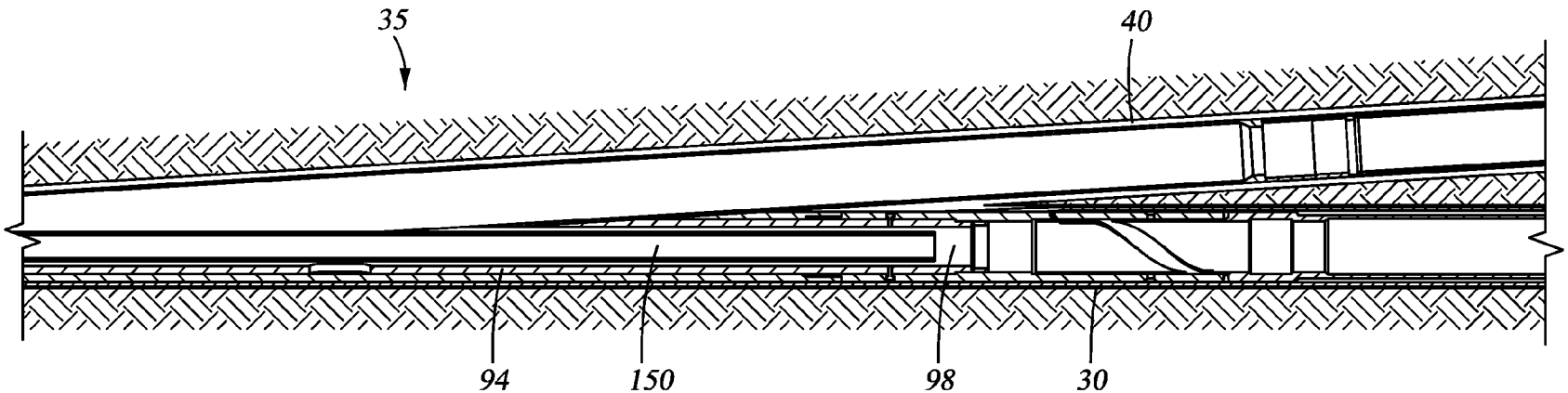
Figure 35:
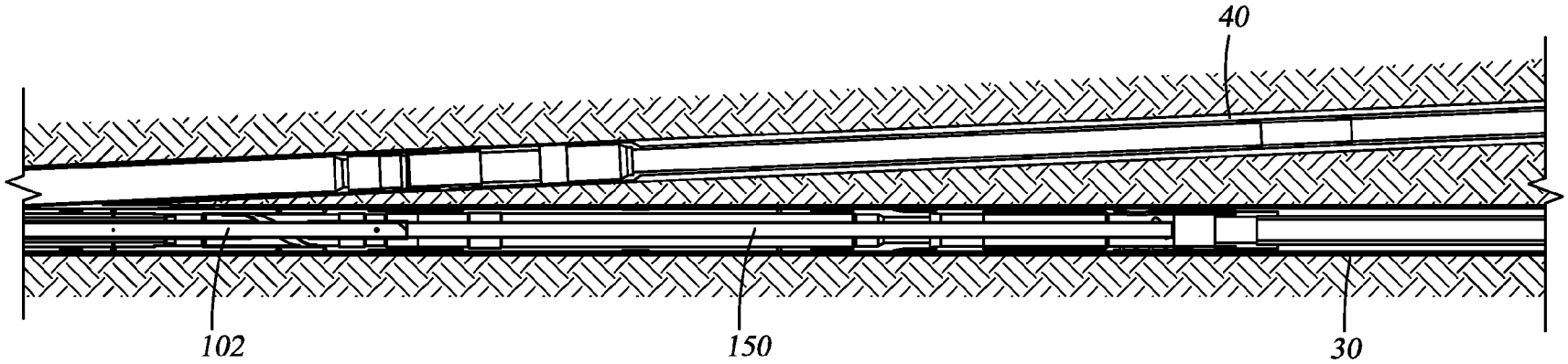
Figure 36:
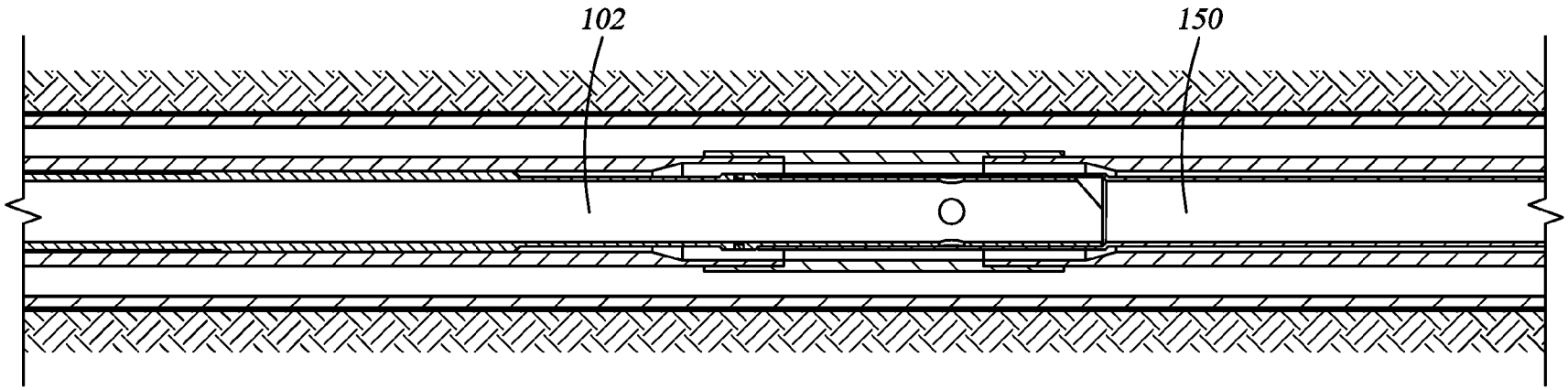

Referring now to FIG. 33, the shroud 104 aligns the tubing 102 with the main borehole 30 at the junction 35. In some embodiments, as shown, the tubing 102 may include the protector 150 extending from the end of the tubing 102. The tubing 102 may now be lowered or advanced toward the main borehole 30 in the junction 35, as shown in FIG. 34. The tubing 102 is no longer restrained from downward movement in the shroud 104, as the leaf springs 114 have been sheared from the tubing 102 and deflected radially outward and the shoulder retention mechanism 118, 168 only restrains upward movement of the tubing 102 relative to the shroud 104. Further, the outer diameter of the tubing 102 is less than the outer diameter of the shroud 104 and the inner diameter of the axial throughbore 98 of the deflector 94 such that the tubing 102 can enter the throughbore 98 and pass through the deflector 94, as shown in FIG. 34. FIGS. 35 and 36 show continued advancement of the tubing 102 for fracturing or other operations.

After fracturing operations in the main borehole 30 are complete, the tubing 102 is pulled upward and engaged with the end 108 of the shroud 104 as previously described. The tubing retainer 168 catches on the shroud engagement shoulder 118 to pull the shroud 104 upward and out of the hole via the tubing 102 as an assembly.

The various embodiments described herein exemplify an apparatus adapted to deliver a tubular member to multiple boreholes in a single trip downhole. In some embodiments, an outer shroud is releasably coupled to an inner tubing. In some embodiments, the coupling between the shroud and the tubing includes outwardly biased spring members on the shroud that are shear bolted to the tubing. The tubing is released from the shroud by shearing the bolts, which also serves to allow the spring members to deflect radially outward and increase the outer diameter of the shroud. The released tubing is allowed downward movement relative to the shroud to enter a first borehole for further operations through the tubing. In some embodiments, upward movement of the tubing relative to the shroud is prevented by interacting retainers and engagement shoulders on the shroud and tubing. When engaged, these components allow the tubing to again move the shroud and tubing as an assembly, upward out of the first borehole. In some embodiments, the outwardly adjustable spring members increase the diameter of the shroud to engage an undercut or shoulder disposed above a second borehole. The outwardly disposed spring members retain and secure the shroud above the second borehole, and the tubing is again allowed to move downward relative to the shroud to enter the second borehole for further operations.

In other embodiments, the spring members shear bolted to the tubing are in a retracted position securing the shroud to the tubing and allowing entry of the tubing assembly into the junction and the lateral borehole. Upon release, the spring members move to an expanded position wherein the tubing is allowed to move relative to the shroud and the shroud is prevented from re-entry into the junction. While being prevented from re-entry into the junction, the shroud aligns the assembly with the main borehole such that the tubing can be directed into the main borehole.

In some embodiments, the selective fracture tubing assembly apparatus is designed to selectively enter the lateral bore to give access to the lateral bore with the fracture string, fracture the lateral bore, and then selectively enter the main bore to allow fracture of the main bore in one trip downhole. The fracture apparatus runs into the lateral bore and shoulders at a specified point in the lateral bore. The fracture string shears away from the fracture apparatus and then advances into the lateral and the well can be fractured. Once work is complete in the lateral bore, the fracture string is pulled out of the lateral. As it exits the lateral it engages the selective fracture apparatus and pulls it out of the lateral with the string. As the fracture string and apparatus is pulled out of the lateral bore into the top of the junction, the selective fracture apparatus snaps, by means of spring loaded dogs, into location allowing selective fracture string to now access the main bore. The fracture string advances into the main bore to fracture the well. Once complete, the fracture string is pulled out of the main bore. As the string exits the main bore it engages the fracture apparatus pulling it out of the hole to surface.

In an embodiment, a method for selectively entering multiple boreholes with a tubing string includes disposing a tubing string in a first bore of a primary well, executing a first operation in the first bore using the tubing string, removing the tubing string from the first bore and disposing the tubing string in a second bore in a single trip of the tubing string into the primary well, and executing a second operation in the second bore using the tubing string.

The embodiments set forth herein are merely illustrative and do not limit the scope of the disclosure or the details therein. It will be appreciated that many other modifications and improvements to the disclosure herein may be made without departing from the scope of the disclosure or the inventive concepts herein disclosed. Because many varying and different embodiments may be made within the scope of the inventive concept herein taught, including equivalent structures or materials hereafter thought of, and because many modifications may be made in the embodiments herein detailed in accordance with the descriptive requirements of the law, it is to be understood that the details herein are to be interpreted as illustrative and not in a limiting sense.

What is claimed is:

1. A tubing assembly for selectively entering multiple boreholes of a well on a single trip into the well, the assembly comprising:

an outer shroud having an outer diameter corresponding to a first of the multiple boreholes and an axial throughbore; and an inner tubular member disposed in the axial throughbore;

wherein the tubular member is releasably coupled to the shroud to allow said inner tubular member access to a first of the boreholes;

wherein the outer diameter of the shroud is adjustable with a moveable member to correspond with a second of the multiple boreholes.

2. The assembly of claim 1 wherein the releasable coupling between the tubular member and the shroud increases the outer diameter of the shroud when released.

3. The assembly of claim 1 wherein the releasable coupling comprises the moveable member formed in the outer shroud, wherein the moveable member is radially outwardly biased to an increased diameter position of the outer shroud.

4. The assembly of claim 3 wherein the moveable member comprises a leaf spring including a latch dog.

5. The assembly of claim 3 wherein the moveable member comprises a radially contracted position wherein a shear member releasably couples the moveable member and the outer shroud to the tubular member.

6. The assembly of claim 1 further comprising an interacting retention mechanism resisting upward movement of the tubular member relative to the shroud.

7. The assembly of claim 6 wherein the interacting retention mechanism comprises a first engagement shoulder on the tubular member and a second engagement shoulder on the shroud.

8. The assembly of claim 7 wherein the second engagement shoulder is disposed on collets at an upper end of the shroud.

9. The assembly of claim 1 further comprising a deflector anchored in a first borehole and adjacent a junction between the first borehole and a second borehole.

10. The assembly of claim 9 wherein the deflector comprises a ramp and an axial throughbore with an inner diameter.

11. The assembly of claim 10 wherein the outer diameter of the shroud is greater than the inner diameter of the deflector throughbore.

12. The assembly of claim 9 further comprising a receptacle disposed in the second borehole to receive the outer shroud.

13. The assembly of claim 9 further comprising a polished bore protector disposed in the second borehole to receive and connect to the tubular member.

14. The assembly of claim 10 further comprising an engagement shoulder on the first borehole above the junction, wherein the moveable member on the outer shroud engages the shoulder to prevent downward movement of the shroud in the first borehole.

15. The assembly of claim 14 wherein an outer diameter of the tubular member is less than the inner diameter of the deflector throughbore for passage of the tubular member through the deflector throughbore.

16. A tubing assembly for selectively entering multiple boreholes of a well on a single trip into the well, the assembly comprising:

a shroud having an axial throughbore;

a moveable tubular member disposed in the axial throughbore; and a releasable coupling between the shroud and the tubular member;

wherein the releasable coupling includes a retracted diameter position allowing entry of the tubing assembly into a junction between two boreholes for advancement of said tubular member into a first of the boreholes in conjunction with attaining an expanded position;

wherein the expanded diameter position prevents re-entry of the tubing assembly into the junction and allows advancement of said tubular member into a second of the boreholes.

17. The assembly of claim 16 wherein a shear member couples to a leaf spring of the releasable coupling in the retracted position, and the member is sheared to outwardly release the leaf spring in the expanded position.

18. The assembly of claim 16 wherein the retracted releasable coupling bypasses a borehole engagement shoulder above the junction, and a tubular member shoulder engages a shroud shoulder and a moveable member of the releasable coupling engages the borehole shoulder in the expanded position.

19. A method for selectively entering first and second bores of a primary well with a tubing string, the method comprising:

coupling a tubing string to an outer shroud to form an assembly, the string configured for first and second operations within the first and second bores in a single trip in the well;

passing the assembly through a borehole shoulder disposed above a junction between the first and second bores;

deflecting the assembly into the first bore;

releasing the tubing string from the outer shroud; and extending the tubing string from the outer shroud further into the first bore.

20. The method of claim 19 further comprising:

retracting the tubing string from the first bore;

engaging the tubing string with the outer shroud to re-form the assembly; and lifting the assembly above the junction.

21. The method of claim 20 further comprising:

radially expanding a portion of the outer shroud;

lowering the assembly;

engaging the expanded shroud portion with the borehole shoulder above the junction; and extending the tubing string from the outer shroud into the second bore.

* * * * *